US009925102B2

(12) United States Patent
Turner et al.

(10) Patent No.: US 9,925,102 B2
(45) **Date of Patent: *Mar. 27, 2018**

(54) PERSON SUPPORT SYSTEM WITH WIDTH EXPANSION WINGS WHICH REACH EXTENSION LIMITS AT DIFFERENT TIMES

(71) Applicant: Hill-Rom Services, Inc., Batesville, IN (US)

(72) Inventors: Jonathan D. Turner, Dillsboro, IN (US); John D. Christie, Batesville, IN (US); Joseph A. Ernst, Cincinnati, OH (US); David P. Lubbers, Cincinnati, OH (US); Scott M. Corbin, Sunman, IN (US); Mark E. Lanning, Mt. Pleansant, SC (US); Mahesh Kumar Thodupunuri, Troy, OH (US); Aziz Ali Bhai, Fishers, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/603,821

(22) Filed: May 24, 2017

(65) Prior Publication Data

US 2017/0252243 A1 Sep. 7, 2017

Related U.S. Application Data

(63) Continuation of application No. 14/548,647, filed on Nov. 20, 2014, now Pat. No. 9,757,293, which is a (Continued)

(51) Int. Cl.

*A61G 7/015* (2006.01)
*A61G 7/00* (2006.01)

(Continued)

(52) U.S. Cl.

CPC ..... *A61G 7/015* (2013.01); *A61G 7/002* (2013.01); *A61G 7/018* (2013.01); *A61G 7/0514* (2016.11);

(Continued)

(58) Field of Classification Search

CPC ..... A61G 7/002; A61G 7/015; A61G 220/16; A61G 7/018; A61G 7/0514; A61G 13/129

See application file for complete search history.

(56) References Cited

U.S. PATENT DOCUMENTS

RE19,272 E * 8/1934 Kurkchee ..... A47C 19/04 5/183
4,805,249 A * 2/1989 Usman ..... A61G 7/00 5/604

(Continued)

FOREIGN PATENT DOCUMENTS

EP 0074460 A1 3/1983
EP 2762122 A2 8/2014

(Continued)

OTHER PUBLICATIONS

International Search Report for International Application No. PCT/US2014/042342; dated Jun. 13, 2014; Aythorized officer—Blaine R. Copenheaver; dated Nov. 14, 2014.

(Continued)

*Primary Examiner* — Eric J Kurilla

(57) ABSTRACT

A system for changing the width of a person support apparatus includes a bed controller for receiving a command signal indicating a command for width alteration, a first motor controlled by the bed controller for driving an extension of a first deck section of the support apparatus thereby altering the width of the first deck section, and a second motor controlled by the bed controller for driving an extension of a second deck section of the support apparatus thereby altering the width of the second deck section. The bed controller controls the first motor and the second motor in a manner that causes the first deck section to reach a first deck section width alteration limit at a first time and the second deck section to reach a second deck section width (Continued)

alteration limit at a second time, wherein the first time and the second time are not equal.

9 Claims, 28 Drawing Sheets

Related U.S. Application Data continuation-in-part of application No. PCT/US2014/042342, filed on Jun. 13, 2014.

(60) Provisional application No. 61/835,534, filed on Jun. 15, 2013.

(51) Int. Cl.

| | |
|---|---|
| ***A61G 7/018*** | (2006.01) |
| ***A61G 7/002*** | (2006.01) |
| ***A61G 7/05*** | (2006.01) |
| ***A61G 7/057*** | (2006.01) |
| *A61G 7/005* | (2006.01) |

(52) U.S. Cl.

CPC ..... *A61G 7/0524* (2016.11); *A61G 7/05792* (2016.11); *A61G 7/005* (2013.01); *A61G 7/05769* (2013.01); *A61G 2200/16* (2013.01); *A61G 2203/20* (2013.01)

(56) References Cited

U.S. PATENT DOCUMENTS

| | | | | |
|---|---|---|---|---|
| 5,632,254 | A | 12/1997 | Boettcher | |
| 6,357,065 | B1 * | 3/2002 | Adams | A47C 19/04 5/611 |
| 7,472,437 | B2 * | 1/2009 | Riley | A47C 19/045 250/221 |
| 7,730,562 | B2 * | 6/2010 | Hornbach | A47C 19/045 5/185 |
| 2004/0255386 | A1 * | 12/2004 | Liu | A61G 7/05776 5/710 |
| 2006/0026767 | A1 * | 2/2006 | Chambers | A61G 7/0507 5/713 |
| 2006/0026768 | A1 * | 2/2006 | Chambers | A61G 7/05776 5/713 |
| 2007/0136949 | A1 * | 6/2007 | Richards | A61G 7/05 5/600 |
| 2008/0000028 | A1 * | 1/2008 | Lemire | A61G 7/001 5/618 |
| 2008/0289108 | A1 * | 11/2008 | Menkedick | A61G 7/0528 5/610 |
| 2009/0070942 | A1 | 3/2009 | Chambers et al. | |
| 2009/0077748 | A1 | 3/2009 | Kim | |
| 2011/0047709 | A1 * | 3/2011 | Tarsaud | A61G 7/05776 5/710 |
| 2011/0162141 | A1 | 7/2011 | Lemire et al. | |
| 2012/0054965 | A1 * | 3/2012 | Kummer | A61G 7/00 5/615 |
| 2012/0259245 | A1 * | 10/2012 | Receveur | A61G 7/05769 600/587 |
| 2013/0298331 | A1 * | 11/2013 | Bossingham | A61G 7/002 5/613 |
| 2014/0047641 | A1 * | 2/2014 | Thodupunuri | A61G 7/002 5/613 |
| 2014/0215717 | A1 * | 8/2014 | Rigsby | A61G 7/002 5/613 |

FOREIGN PATENT DOCUMENTS

| | | | |
|---|---|---|---|
| FR | 2726982 | A1 | 5/1996 |
| WO | 2014144593 | A1 | 9/2014 |

OTHER PUBLICATIONS

Written Opinion for International Application No. PCT/US2014/042342; dated Jun. 13, 2014; Date of Completion of Opinion—Sep. 25, 2014; Authorized Officer—Blaine R. Copenheaver; dated—Nov. 14, 2014.

European Search Report for EP Application No. 15170984.7; dated Oct. 29, 2015; Place of Search—The Hague; Date of completion of the Search—Oct. 22, 2015.

Response to European Search Report for EP Application No. 15170984.7; dated Jun. 15, 2016.

Claims—Final for EP Application No. 15170984.7.

Claims—Tracked for EP Application No. 15170984.7.

Amended Pages—Final for EP Application No. 15170984.7.

Amended Pages—Tracked for EP Application No. 15170984.7.

Replacement Drawings for EP Application No. 15170984.7.

Communication from Reddie & Grose; dated Feb. 10, 2017; European Patent Application No. 16164283.0; Adjustable Person Support System with expansion Wings Driven by Dual Leadscrews and Center Mounted Motors; of Hill-Rom Services, Inc. Reference. P/72816.EP02/AF/nc.

Amended pages red lined Title—Adjustable Person Support System With Expansion Wings Driven by Dual Leadscrews and Center Mounted Motors; pp. 1, 2, 7, 24, 25, 26, 27, 28, and 29, filed in response to European search report / dated Jul. 27, 2016 for European Application 2016164283.

Amended pages final Titled—Adjustable Person Support Sytstem With Expansion Wings Driven by Dual Leadscrews and Center Mounted Motors; pp. 1, 2, 7, and 24, filed in response to European search report / dated Jul. 27, 2016 for European Application 2016164283.

Claims; p. 30; Final European search report / dated Jul. 27, 2016 for European Application 2016164283.

Claims; p. 30; red lined European search report / dated Jul. 27, 2016 for European Application 2016164283.

Figure 5, filed in response to European search report / dated Jul. 27, 2016 for European Application 2016164283.

Extended European Search Report and Abstract; Reference P/72816.EP02/AF; Application No./Patent No. 161642830-1651 / 3058923; Place of Search: The Hague; Date of Completion: Jul. 11, 2016.

European Search Report for EP Application No. 13166067.2; Place of Search: The Hague; Date of Completion of the Search—Feb. 17, 2014.

European Search Report Response for EP Applicatio No. 13166067.2; dated Sep. 24, 2014.

Specification for European Application No. 13166067.2.

Claims for European Application No. 13166067.2.

* cited by examiner

PERSON SUPPORT SYSTEM WITH WIDTH EXPANSION WINGS WHICH REACH EXTENSION LIMITS AT DIFFERENT TIMES

This application is a continuation of U.S. patent application Ser. No. 14/548,647 filed on May 14, 2015, which is a continuation in part of International Application PCT/US2014/042342 filed on Jun. 13, 2014 and which claims priority to U.S. Provisional Patent Ser. No. 61/835,534 filed on Jun. 15, 2013. The contents of the foregoing applications are hereby incorporated herein by reference.

BACKGROUND

This disclosure relates to adjustable person support systems. More particularly, but not exclusively, one contemplated embodiment relates to a person support apparatus and mattress configurable to increase and decrease in length and/or width to accommodate a person supported thereon. While various length and/or width adjusting person support systems have been developed, there is still room for improvement. Thus, a need persists for further contributions in this area of technology.

BRIEF SUMMARY

A system for changing the width of a person support apparatus includes a bed controller for receiving a command signal indicating a command for width alteration, a first motor controlled by the bed controller for driving an extension of a first deck section of the support apparatus thereby altering the width of the first deck section, and a second motor controlled by the bed controller for driving an extension of a second deck section of the support apparatus thereby altering the width of the second deck section. The bed controller controls the first motor and the second motor in a manner that causes the first deck section to reach a first deck section width alteration limit at a first time and the second deck section to reach a second deck section width alteration limit at a second time, wherein the first time and the second time are not equal.

Another contemplated embodiment includes a person support system, comprising: a person support apparatus including at least one of a width and length extension assembly; a person support surface configured to be supported on the person support apparatus and including at least one of a length and width extension assembly; a controller configured to cause at least one of the width and length extension assembly of the person support apparatus and the person support surface to move in response to an input from a user, wherein the at least one of the length and width extension assembly for the person support surface will remain in a retracted position unless the corresponding one of the at least one of the width and length extension assembly of the person support apparatus is positioned in one of a fully retracted position and a fully extended position.

Another contemplated embodiment includes a person support system, comprising: a person support apparatus including a first size adjusting assembly; a person support surface configured to be supported on the person support apparatus and including a second size adjusting assembly; a controller configured to cause at least one of the first size adjusting assembly of the person support apparatus and the second size adjusting assembly of the person support surface to change the size thereof in response to an input from a user, wherein the size adjusting assembly for the person support surface will remain in a retracted position unless the corresponding size adjusting assembly of the person support apparatus is in one of a fully retracted position and a fully extended position.

Additional features, which alone or in combination with any other feature(s), such as those listed above and/or those listed in the claims, may comprise patentable subject matter and will become apparent to those skilled in the art upon consideration of the following detailed description of various embodiments exemplifying the best mode of carrying out the embodiments as presently perceived.

BRIEF DESCRIPTION OF DRAWINGS

The accompanying drawings incorporated in and forming a part of the specification illustrate several aspects of the claimed subject matter and, together with the description, serve to explain the principles of the claimed subject matter. In the drawings:

DETAILED DESCRIPTION OF ILLUSTRATIVE EMBODIMENTS

Figure 1:
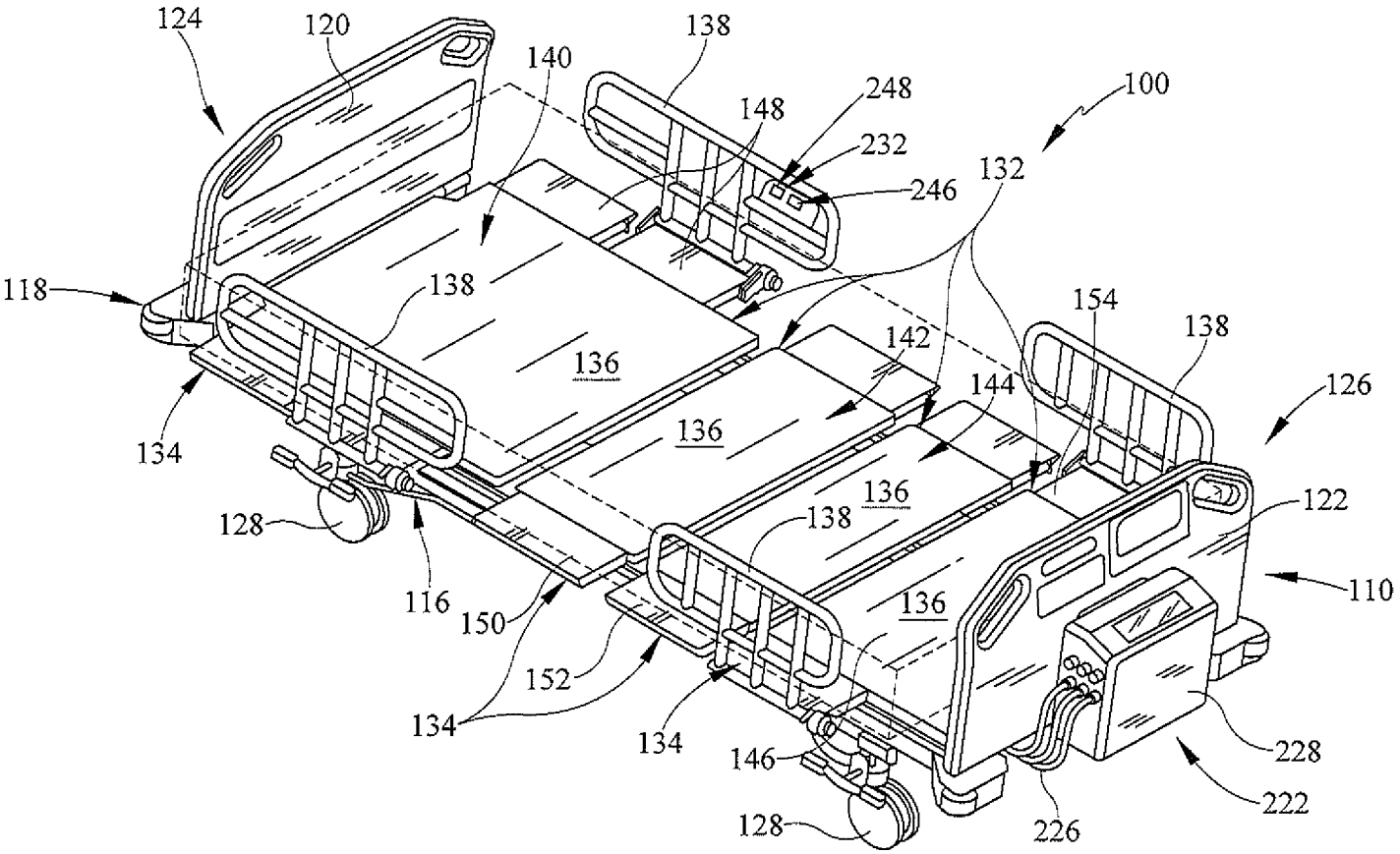
FIG. 1 is a perspective view of an adjustable width person support system, constructed according to one or more of the principles disclosed herein.

The embodiments of the claimed subject matter and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be briefly mentioned or omitted so as to not unnecessarily obscure the embodiments of the claimed subject matter described. The examples used herein are intended merely to facilitate an understanding of ways in which the claimed subject matter may be practiced and to further enable those of skill in the art to practice the embodiments of the claimed subject matter described herein. Accordingly, the examples and embodiments herein are merely illustrative and should not be construed as limiting the scope of the claimed subject matter, which is defined solely by the appended claims and applicable law. Moreover, it is noted that like reference numerals represent similar parts throughout the several views of the drawings. It is understood that the subject matter claimed is not limited to the particular methodology, protocols, devices, apparatus, materials, applications, etc., described herein, as these may vary. It is also to be understood that the terminology used herein is used for the purpose of describing particular embodiments only, and is not intended to limit the scope of the claimed subject matter. Unless defined otherwise, all technical and scientific terms used herein have the same meanings as commonly understood by one of ordinary skill in the art.

A variable width person support system 100 according to one contemplated embodiment is shown in FIGS. 1-19. U.S. patent application Ser. Nos. 11/774,847, 11/775,083, 13/468,424, and 14/168,538 disclosing variable width person support apparatus, related systems and methods of use are hereby expressly incorporated herein by reference. The person support system 100 includes an adjustable width person support apparatus 110, an adjustable width person support surface or mattress 112 configured to be supported on the person support apparatus 110, and a control system 114 configured to control the adjustment of the width of the person support apparatus 110 and mattress 112. One contemplated embodiment of the person support apparatus 110 is shown in FIG. 1 as a bed frame, however, in other embodiments the person support apparatus 110 may be a wheelchair, stretcher or any other apparatus configured to support a person thereon. In another contemplated embodiment, the length of the person support apparatus 110 and mattress 112 can be adjusted. In one example, the length of the person support apparatus 110 and mattress 112 can be adjusted using the Flexafoot™ feature sold by Hill-Rom.

Figure 2:
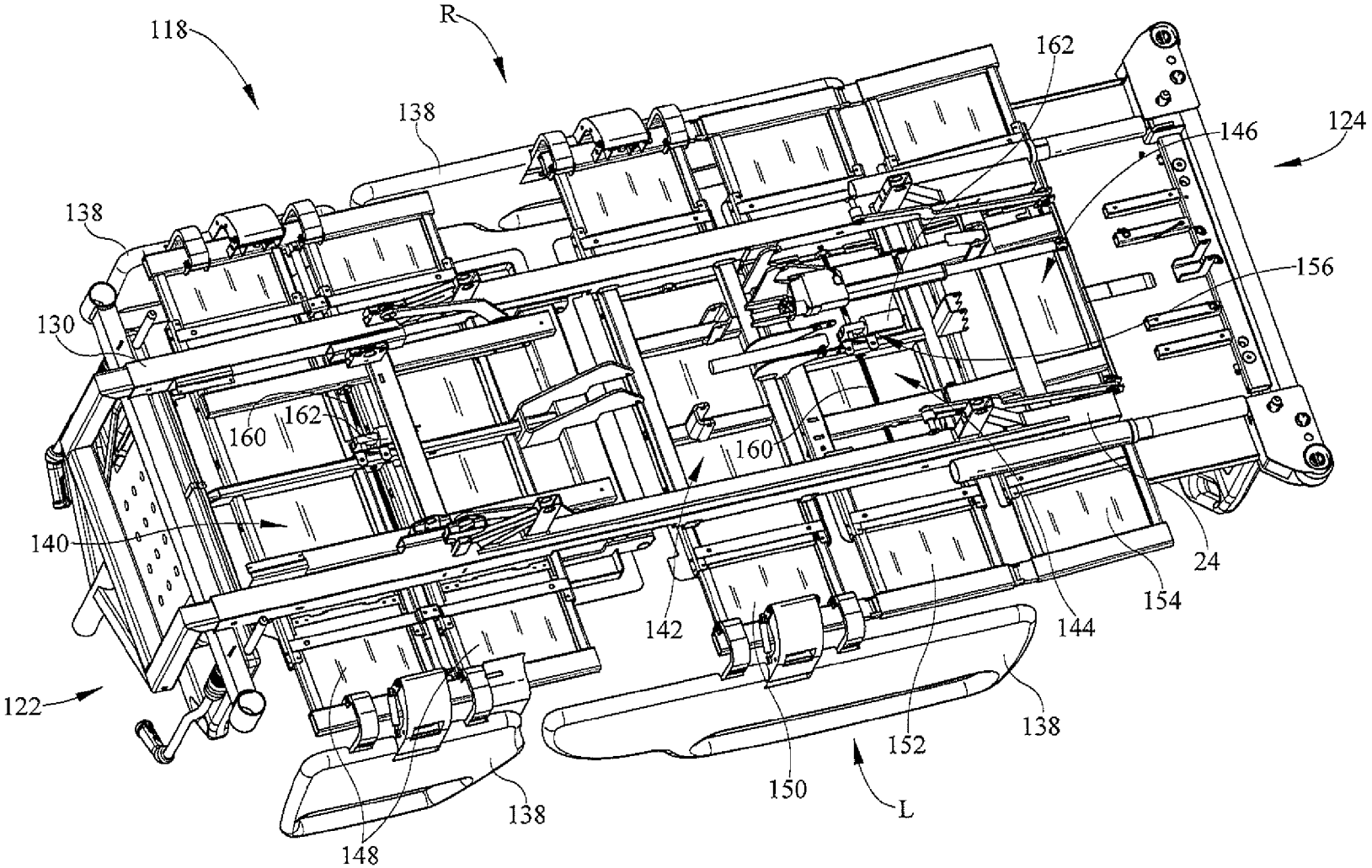
FIG. 2 is a perspective view of the upper frame base, deck sections, and deck extensions as seen by an observer looking from beneath the upper frame.
Figure 3B:
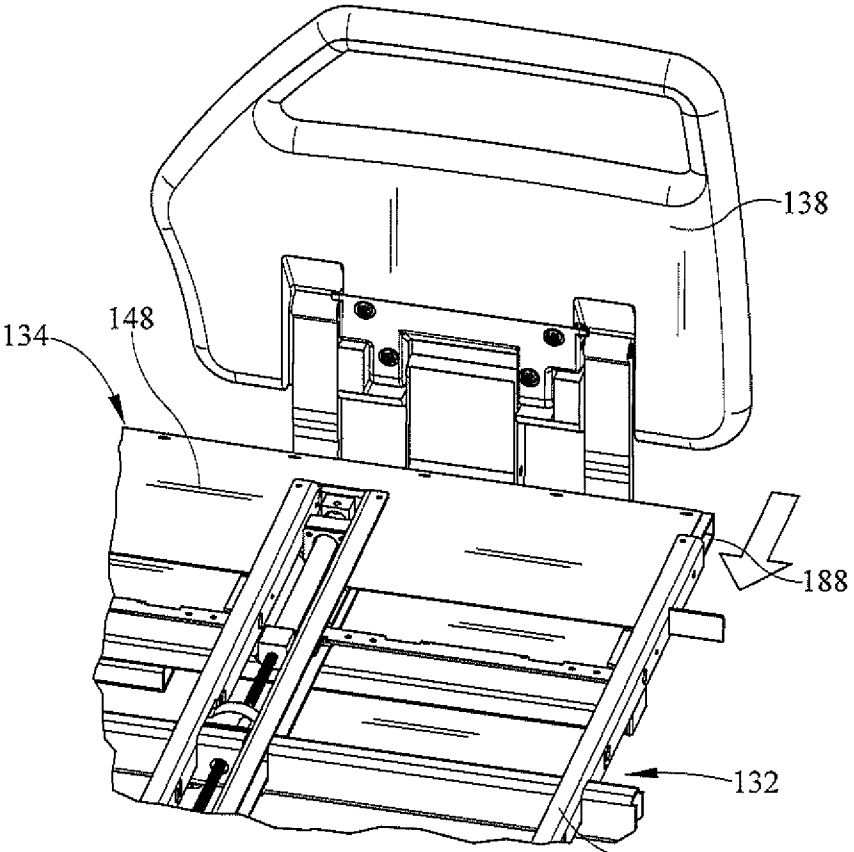
FIGS. 3A and 3B are perspective views showing a side of the upper body deck section with a head deck section extension in its deployed or extended state (FIG. 3A) and in its stored or retracted state (FIG. 3B) as seen by an observer looking from above the segment. A deck panel which rests atop the deck framework is absent from the illustration in order to expose to view components that would otherwise be obscured.
Figure 3A:
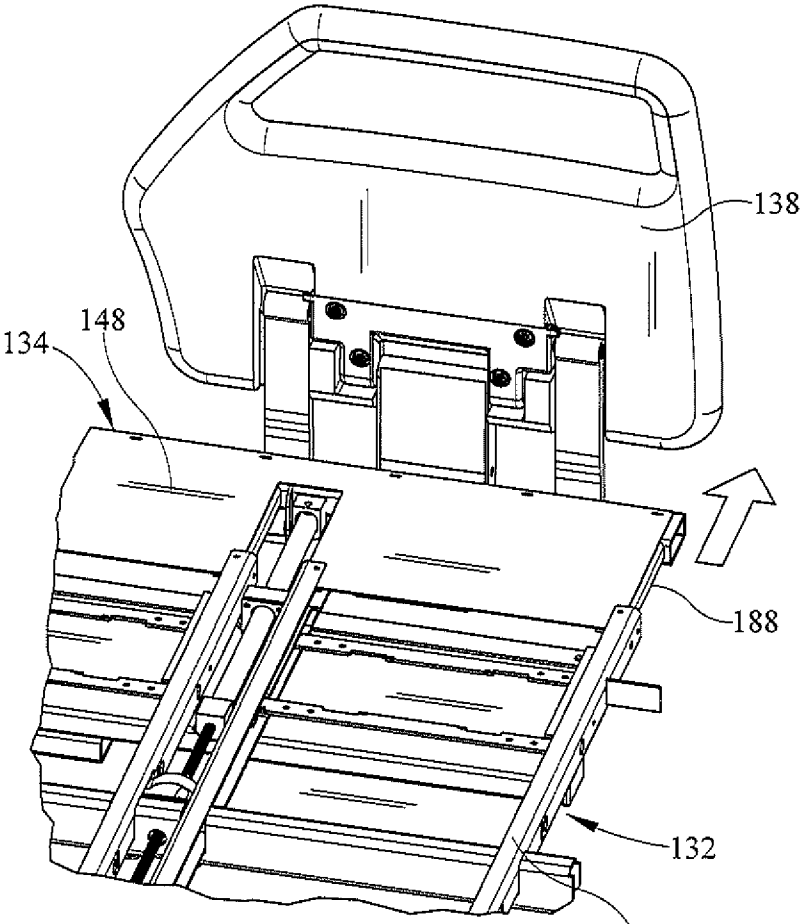
Figure 4:
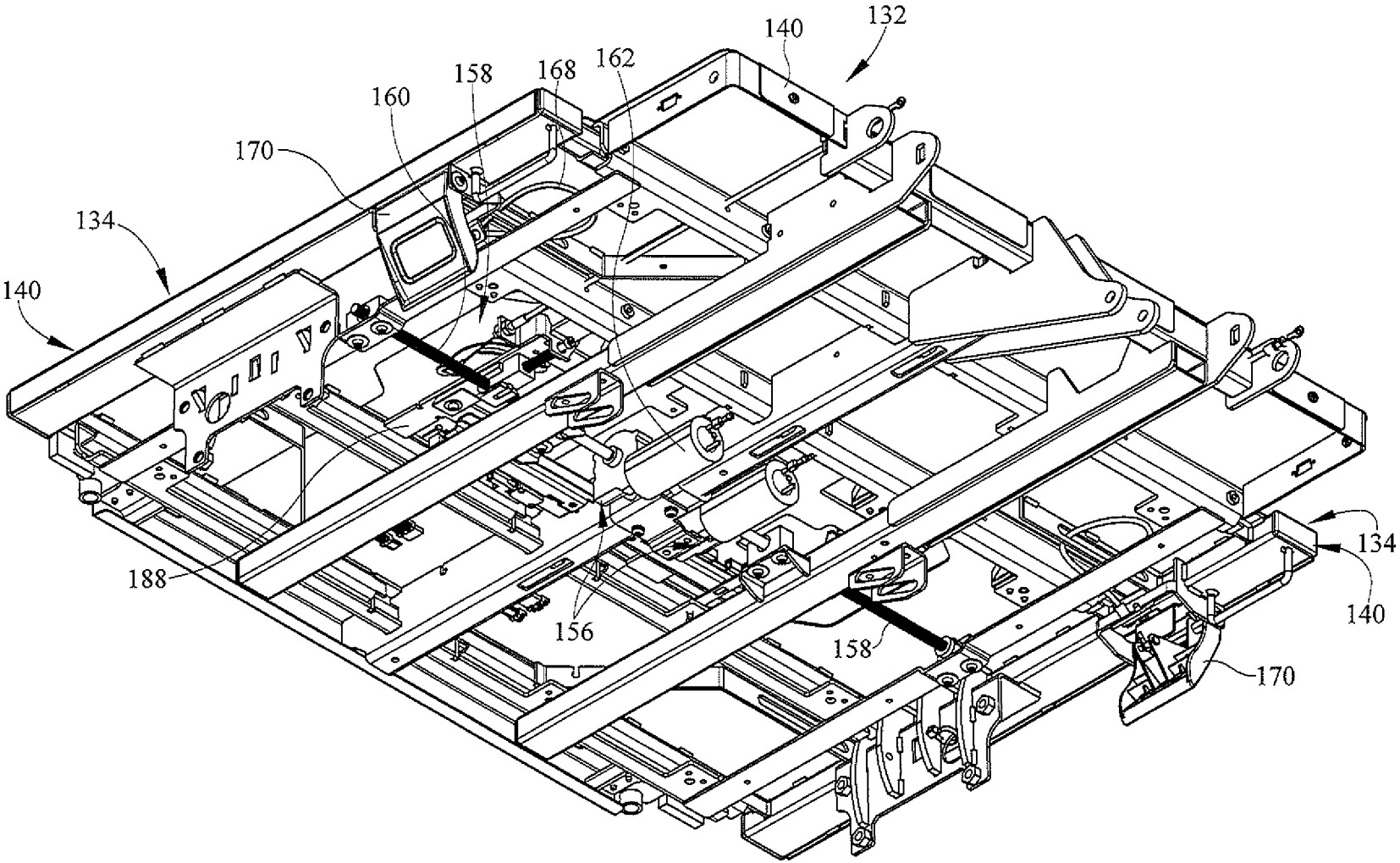
FIG. 4 is a perspective bottom view of the upper body deck section showing the power extension/retraction system and manual release assembly.

The person support apparatus 110 comprises a lower frame 116, an upper frame 118 movably supported above a lower frame 116 by supports (not shown) coupled to the lower frame 116, a head board 120 at the head end 124 of the person support apparatus 110, and a foot board 122 at the foot end 126 of the person support apparatus 110 as shown in FIGS. 1 & 2. The supports are configured to raise and lower at least a portion of the upper frame 118 with respect to the lower frame 116. The lower frame 116 rests on at least one caster wheel 128 in this embodiment, allowing the person supported apparatus 110 to be transported. The upper frame 118 includes an upper frame base 130 coupled to the supports, a plurality of deck sections 132, a plurality of deck extensions 134, a plurality of deck panels 136 supported on the deck sections 132 and deck extensions 134, and siderails 138. The siderails 138 are coupled to the deck extensions 134 and cooperate to define a portion of the perimeter of the person support apparatus 110.

The deck sections 132 are movably coupled to the upper frame base 130 and are configured to be articulated with respect to one another and the upper frame base 130 between a number of configurations including a substantially coplanar configuration, a reclined configuration, a chair configuration, and various other configurations. The deck sections 132 include an upper body deck section 140, seat deck section 142, thigh deck section 144 and foot deck section 146 as shown in FIGS. 1 & 2. Each of the deck sections 132 includes a corresponding extension 134 (an upper body deck extension 148, seat deck extension 150, thigh deck extension 152 and foot deck extension 154) that can be extended and retracted from the deck sections 132 to increase and decrease the width of the person support apparatus 110. In this embodiment, the seat, thigh, and foot deck extensions 150, 152, and 154 are connected to one another and configured to be extended and retracted together; however, in other embodiments the seat, thigh, and foot deck extensions 150, 152, and 154 can be extended/retracted independently.

Figure 14B:
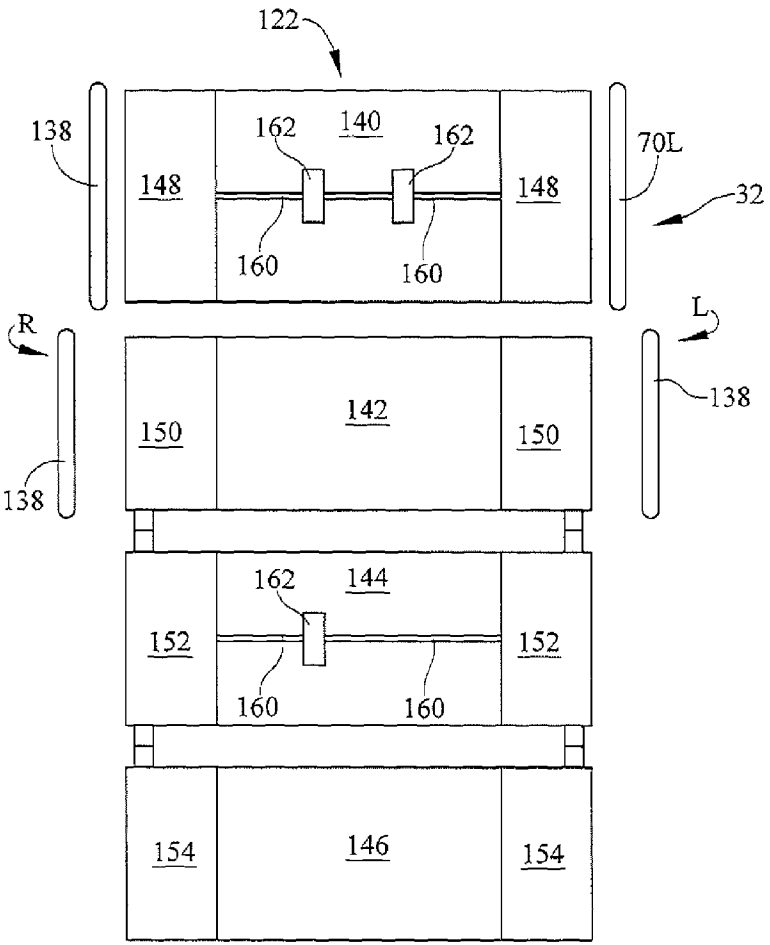
FIGS. 14A and 14B are schematic views of deck extensions staggered according to one or more principles disclosed, wherein the upper body deck extension lags the lower body deck extensions when the deck extensions are extended (FIG. 14A) and leads the lower body deck extensions when the deck extensions are retracted (FIG. 14B)
Figure 14A:
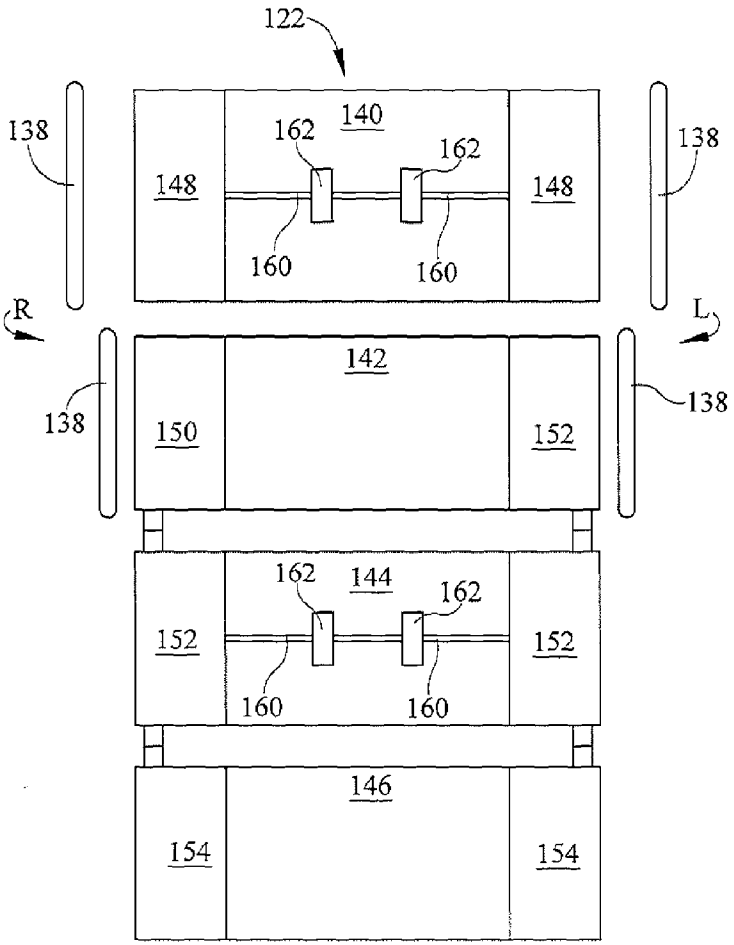

In one contemplated embodiment, a user can choose to extend/retract the deck extensions 134 using a powered extension/retraction system 156 by providing an input to the control system 114 or to manually extend/retract the deck extensions 134 by actuating a manual release assembly 158 to disengage the deck extension 134 from the powered extension/retraction system 156. The powered extension/retraction system 156 includes lead screws 160 rotatably coupled to the deck sections 132 and configured to be rotated by motors 162. In one contemplated embodiment, the seat, thigh, and foot deck extensions 150, 152, and 154 are connected together and a single motor 162 and lead screw 160 are used to extend/retract them as shown in FIGS. 14A & 14B. In one example, a motor 162 is coupled to the upper body deck section 140 and rotates a lead screw 160 when activated by the control system 114 in response to an input from a user to extend/retract the upper body deck extension 148.

The manual release assembly 158 includes a separable threaded clasp 164, a clasp separator 166, a cable 168, and a handle 170 as shown in FIGS. 4-8. In some contemplated embodiments, the clasp 164 is not threaded and is configured to engage and retain a carrier that includes a threaded bore configured to engage the lead screw 160. The threaded clasp 164 includes a first clasp member 172 and a second clasp member 174 that are aligned substantially perpendicular to the lead screw 160 and are configured to engage the lead screw 160 in an engaged position (FIG. 6) when adjacent to one another, and configured to disengage the lead screw 160 in a disengaged position (FIG. 7) when separated from one another. The clasp 164 is moved from the engaged position to the disengaged position by the clasp separator 166 upon actuation of the manual release handle 170 and allows the deck extension 134 to be manually extended/retracted independent of the motion of the lead screw 160. The first clasp member 172 includes a main body portion 176, a first guide 178 protruding from the top of the body 176, a second guide 180 protruding from the bottom of the body 176, a lead screw engaging portion 182, and a guide shaft 184. The first guide 178 is configured to move along a guide slot 186A in the deck extension frame 188 as the first clasp member 172 is moved with respect to the second clasp member 174. In some contemplated embodiments, the first clasp member 172 moves along a path that is substantially perpendicular to the rotational axis of the lead screw 160. The first guide 178 cooperates with the slot 186A to maintain alignment of the first and second clasp members 172 and 174. The second guide 180 is configured to move within a guide slot 190 in the second clasp member 174 and is configured to cooperate with the second clasp guide slot 190 to maintain alignment of the first and second clasp members 172 and 174. The lead screw engaging portion 182 extends from the main body portion 176 and includes a curved end 192 with threads cut therein that are configured to engage the threads on the lead screw 160. The guide shaft 184 extends opposite the threaded body portion 182 and is configured to move within a bore 194 in the deck extension frame 188 as the first clasp member 172 is moved between the engaged position and the disengaged position. A spring 196 is disposed around the guide shaft 184 and is configured to bias the first clasp member 172 toward the engaged position where the first clasp member 172 and second clasp member 174 engage the lead screw 160. When the manual release assembly 158 is actuated, the first clasp member 172 is moved away from the second clasp member 174 toward the disengaged position which causes the spring 196 to compress between the main body portion 176 and the deck extension frame 188. When the manual release assembly is no longer being actuated, the spring 196 expands and biases the first clasp member 172 to move toward the second clasp member 174 and re-engage the lead screw 160.

Figure 5:
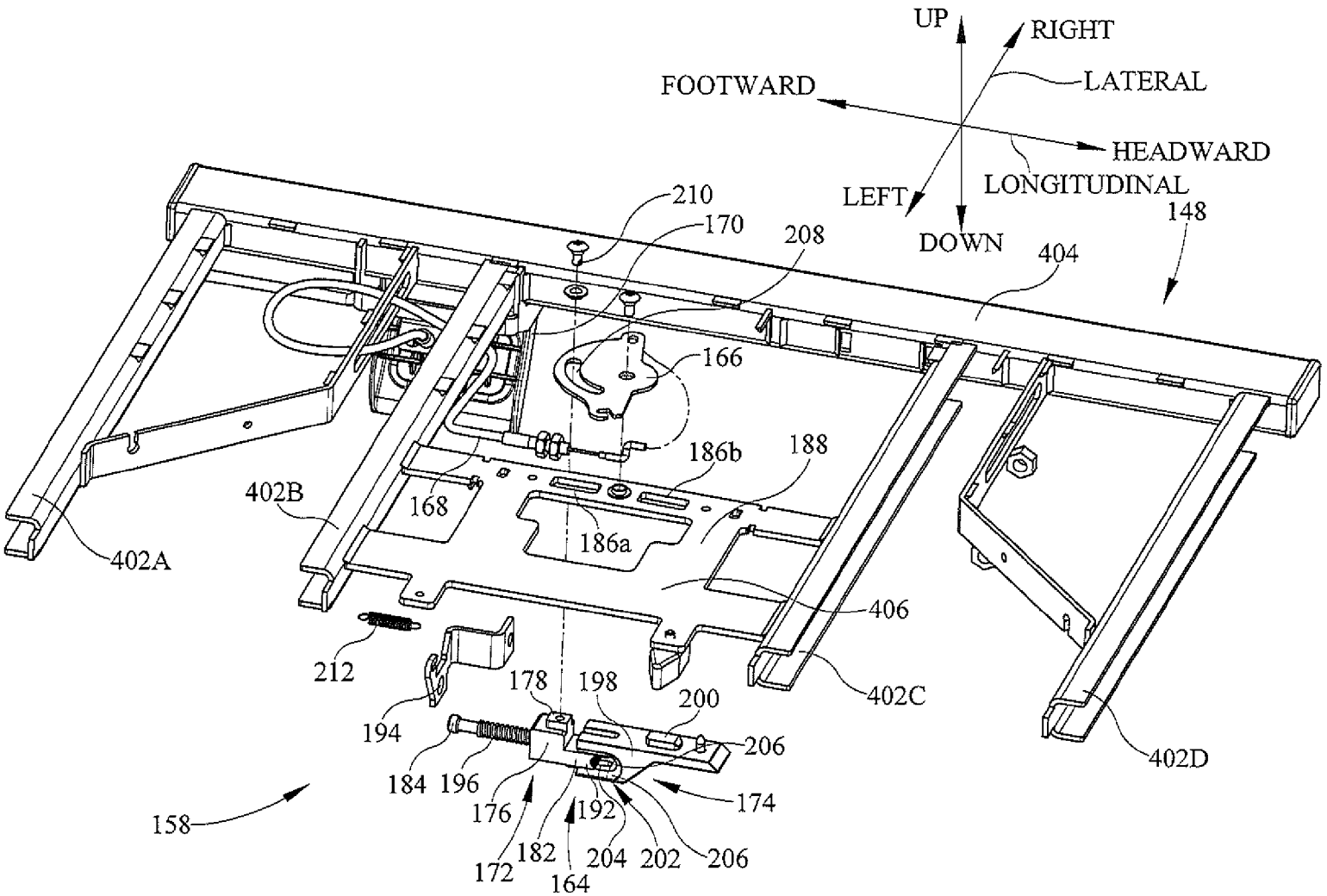
FIG. 5 is an exploded view of the manual release assembly according to one contemplated embodiment.
Figure 6:
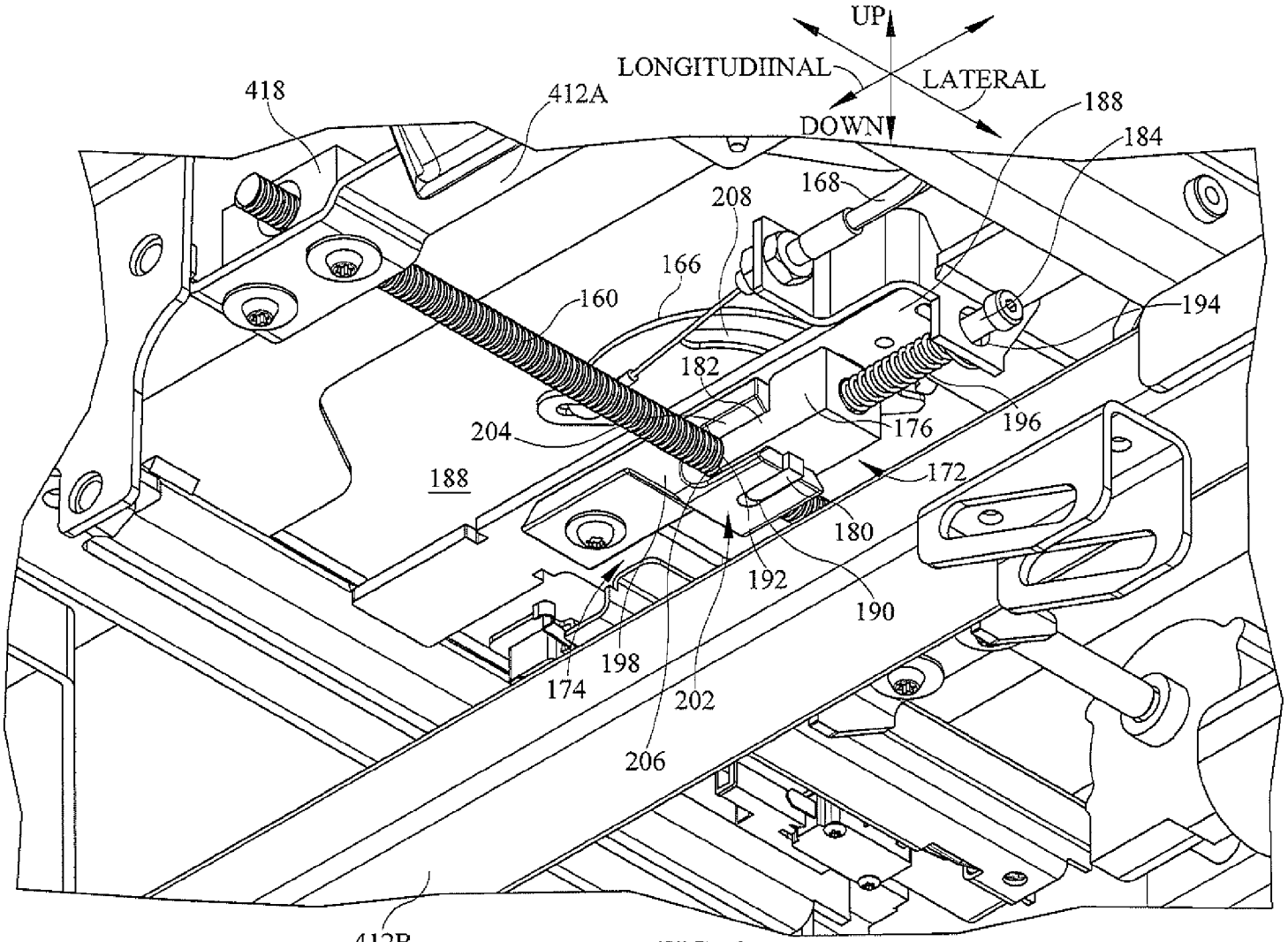
FIG. 6 is a perspective bottom view of the clasps in an engaged position where the clasps engage the lead screw and allow for powered extension/retraction of the deck extension.
Figure 7:
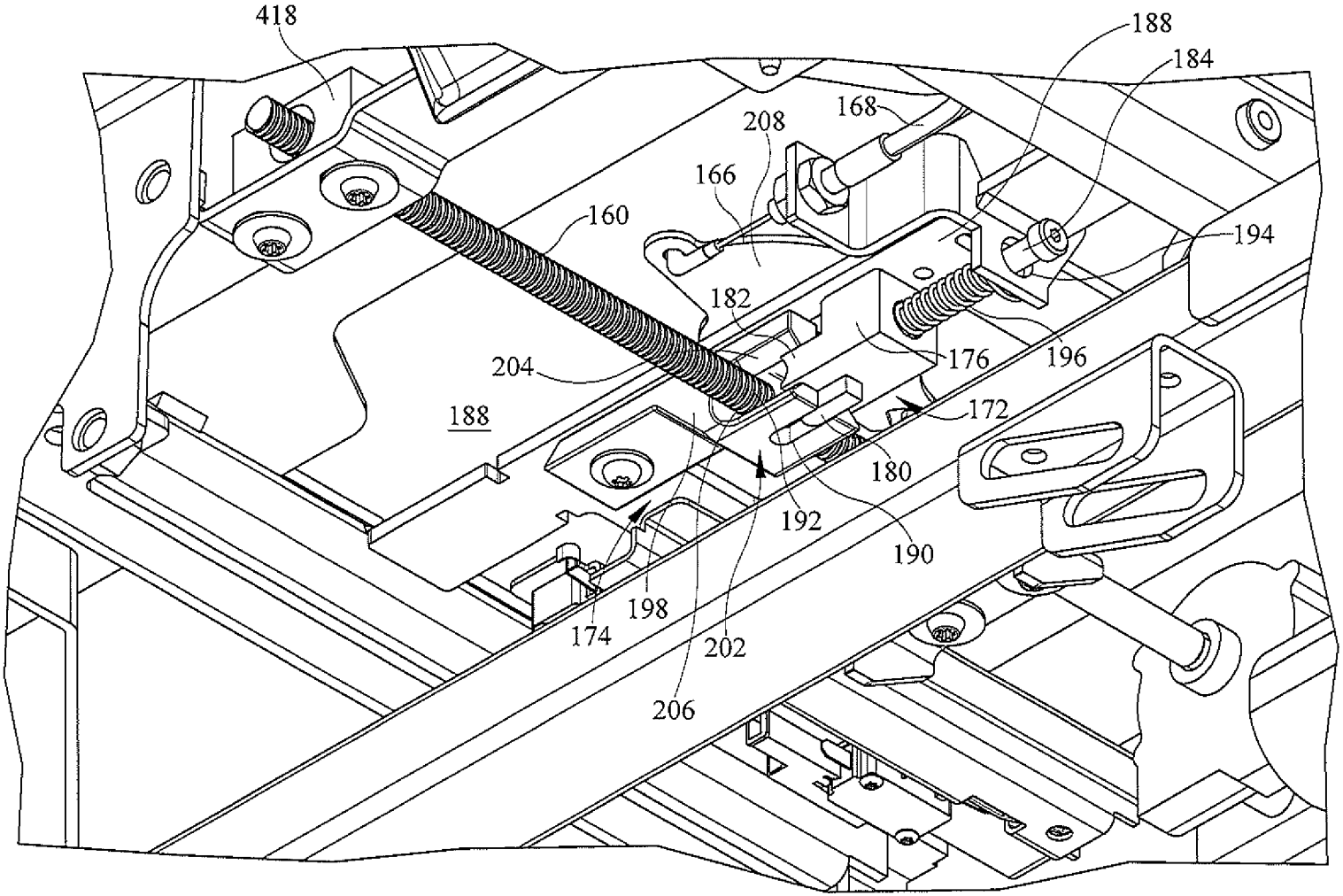
FIG. 7 is a perspective bottom view of the clasps in an disengaged position where one of the clasps doesn't engage the lead screw and the deck extension is movable independent of the lead screw.

The second clasp member 174 is secured to the deck extension 134 and includes a main body portion 198, a first guide 200 protruding from the bottom of the main body portion 198, a guide slot 190 recessed along the top of the main body portion 198, and a receiving portion 202 as shown in FIGS. 5-7. Similar to the first guide 178, the first guide 200 cooperates with slot 186B to maintain alignment of the first and second clasp members 172 and 174. The receiving portion 202 is U-shaped and defines a slot 204 with a non-threaded base 206 recessed into the main body portion 198. The base 206 is not threaded like end 192 of the first clasp member 172 because the second clasp member 174, in this embodiment, is secured to the deck extension 134 and the lead screw 160 remains positioned adjacent to the base 206. Since the lead screw 160 remains positioned adjacent to the base 206, it must be able to rotate freely with respect to the second clasp member 174 when the first clasp member 172 is disengaged from the lead screw 160. The lead screw engaging portion 182 is positioned in the slot 204, the second guide 180 is positioned in the guide slot 190, and end 192 and base 206 engage the lead screw 160 when the first and second clasp members 172 and 174 are in the engaged position. In some contemplated embodiments, the first and second clasp members 172 and 174 can both move with respect to the deck extension frame 188 and, in that embodiment, the base 206 could be threaded to engage the lead screw 160.

The clasp separator 166 is rotatably coupled to the deck extension frame 188 and is configured to move the first clasp member 172 with respect to the deck extension frame 188 and the second clasp member 174 as the clasp separator 166 is rotated as shown in FIGS. 4-8. In one contemplated embodiment, the clasp separator 166 and the threaded clasp 164 are coupled to opposite sides of the deck extension frame 188 (i.e., top and bottom). The clasp separator 166 in this embodiment is semi disc-shaped and includes an curved guide 208 that a follower 210 (such as a fastener coupled to the first guide 178) travels along as the clasp separator 166 rotates and the first clasp member 172 moves with respect to the deck extension frame 188. In some contemplated embodiments, the clasp separator 166 is disc shaped and includes two curved guides that engage followers coupled to the first clasp member 172 and the second clasp member 174 and cause the first and second clasp members 172 and 174 to both move with respect to the deck extension frame 188 and disengage the lead screw 160. A spring 212 is coupled between the clasp separator 166 and a portion of the deck extension frame 188 and configured to help return the clasp separator 166 to the engaged position (where the first clasp portion 172 engages the lead screw 160) from a disengaged position (where the first clasp portion 172 is disengaged from the lead screw 160) when the manual release assembly 158 is no longer being actuated.

The handle 170 is pivotably coupled to the deck extension frame 188 such that it can be easily accessed by a user as shown in FIGS. 4-8. The cable 168 is connected to the handle 170 and to a side of the clasp separator 166 and is configured to cause the clasp separator 166 to rotate with respect to the deck extension frame 188 by creating a rotational moment about the rotational axis of the clasp separator 166 when the handle 170 is pulled by a user. When the user releases the handle 170, the rotational moment caused by the cable 168 is relieved and spring 196 expands (and spring 212 contracts), creating a reverse rotational moment about the rotational axis of the clasp separator 166 and moving the first clasp member 172 into engagement with the lead screw 160. In some contemplated embodiments, the cable 168 could be connected directly to the first clasp member 172 and configured to move it with respect to the deck extension frame 188.

Figure 9:
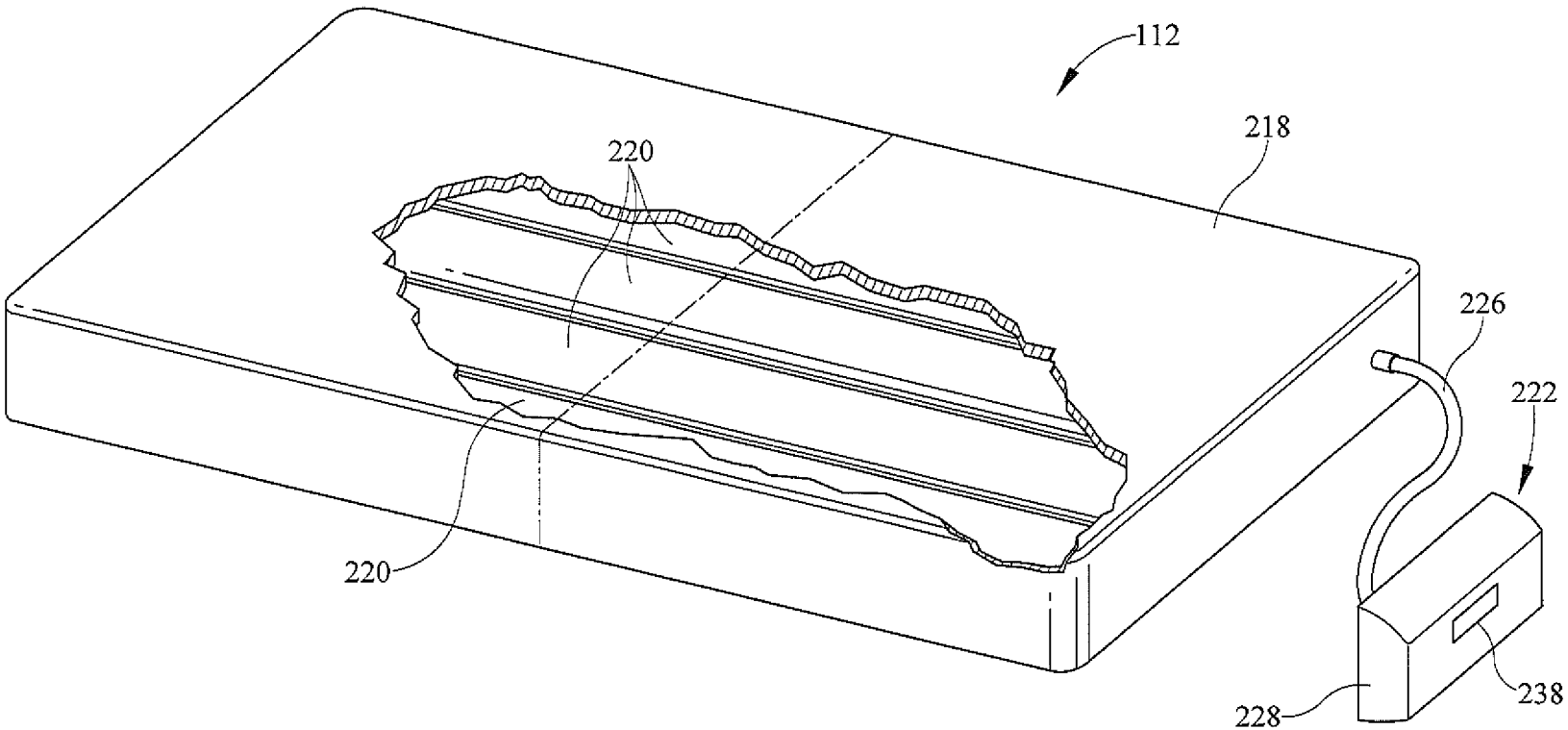
FIG. 9 is a side perspective view of a mattress and fluid supply system configured to be supported on the person support apparatus.
Figure 10:
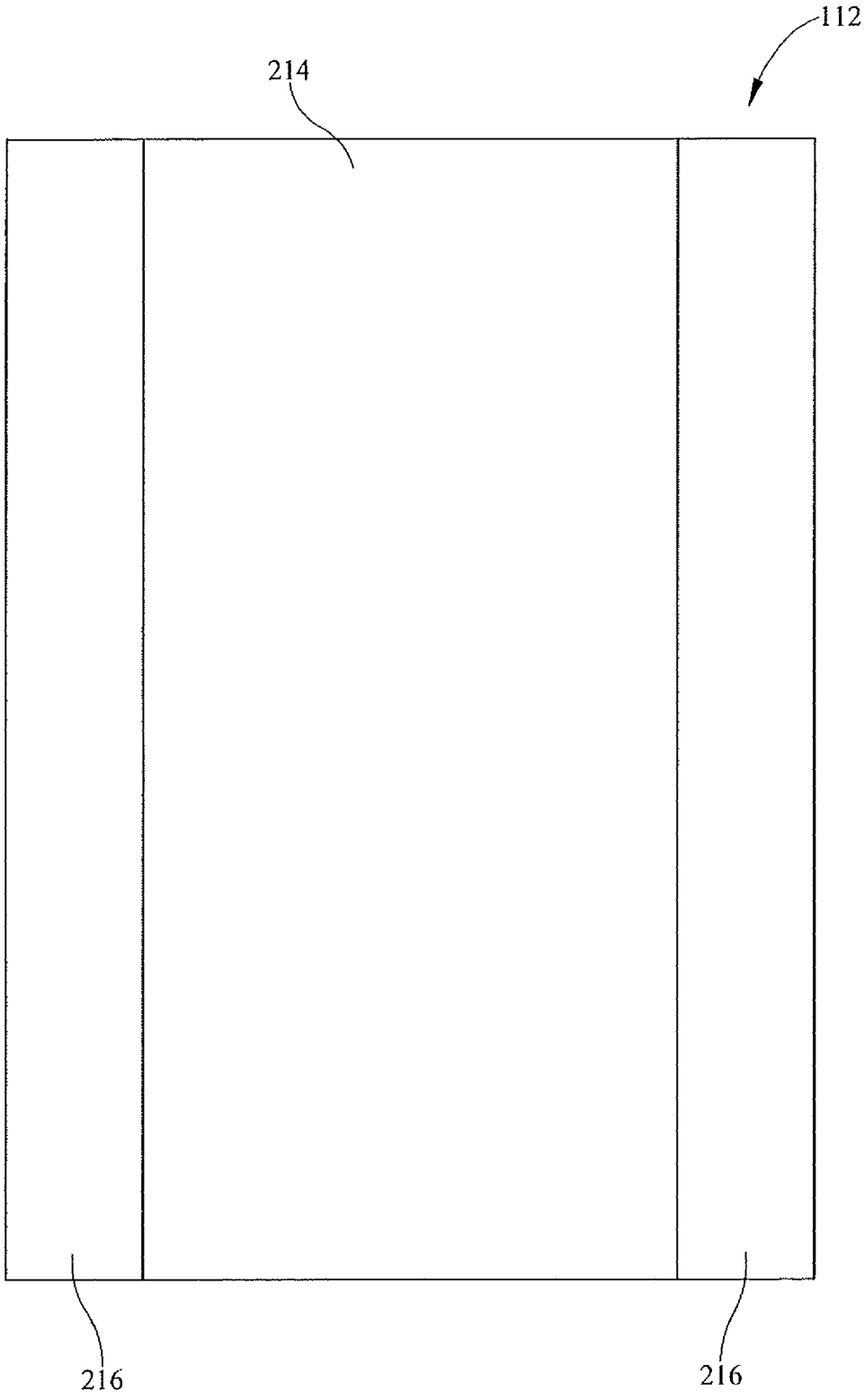
FIG. 10 is a schematic plan view of the mattress configured to be used with changeable width person support apparatus, constructed according to one or more of the principles disclosed herein.

The mattress 112 includes a mattress core 214 and mattress side bolsters 216 on either side of the mattress core 214, and a cover 218 enclosing the mattress core 214 and side bolsters 216 as shown in FIGS. 9 and 10. In some contemplated embodiments, the mattress 112 also includes length bolsters at the foot end of the mattress 112 (such as those used with the Flexafoot™ feature sold by Hill-Rom). In some contemplated embodiments, the mattress 112 is part of a mattress replacement system (MRS system). One example of a mattress replacement system is the Envison® E700 Low-Air Loss Therapy Surface sold by Hill-Rom. In one contemplated embodiment, the mattress core 214 includes a combination of static components (i.e., static fluid bladders or foam) and dynamic components (i.e., inflatable fluid bladders 220), and the mattress side bolsters 216 include at least one inflatable fluid bladder 220 or chamber.

The fluid bladders 220 are in fluid communication with a fluid supply system 222 configured to supply fluid to inflate the bladders 220, or create a vacuum to deflate the bladders 220. In one contemplated embodiment, the fluid supply system 222 is configured to inflate/deflated the fluid bladders 220 in the mattress side bolsters 216 in response to the control system 114 sensing an increase/decrease in the width of the person support apparatus 110 or receiving an input from a user indicating a desire for the width of the person support apparatus 110 or the mattress 112 to be increased/decreased. The fluid supply system 222 includes a fluid supply or gas blower 224 that is connected to the fluid bladders 220 by hoses 226. In some contemplated embodiments, the fluid supply 224 may be a compressor or a pump. The fluid supply 224 is contained within a mattress control box 228 that is hung from the footboard 122.

Figure 11:
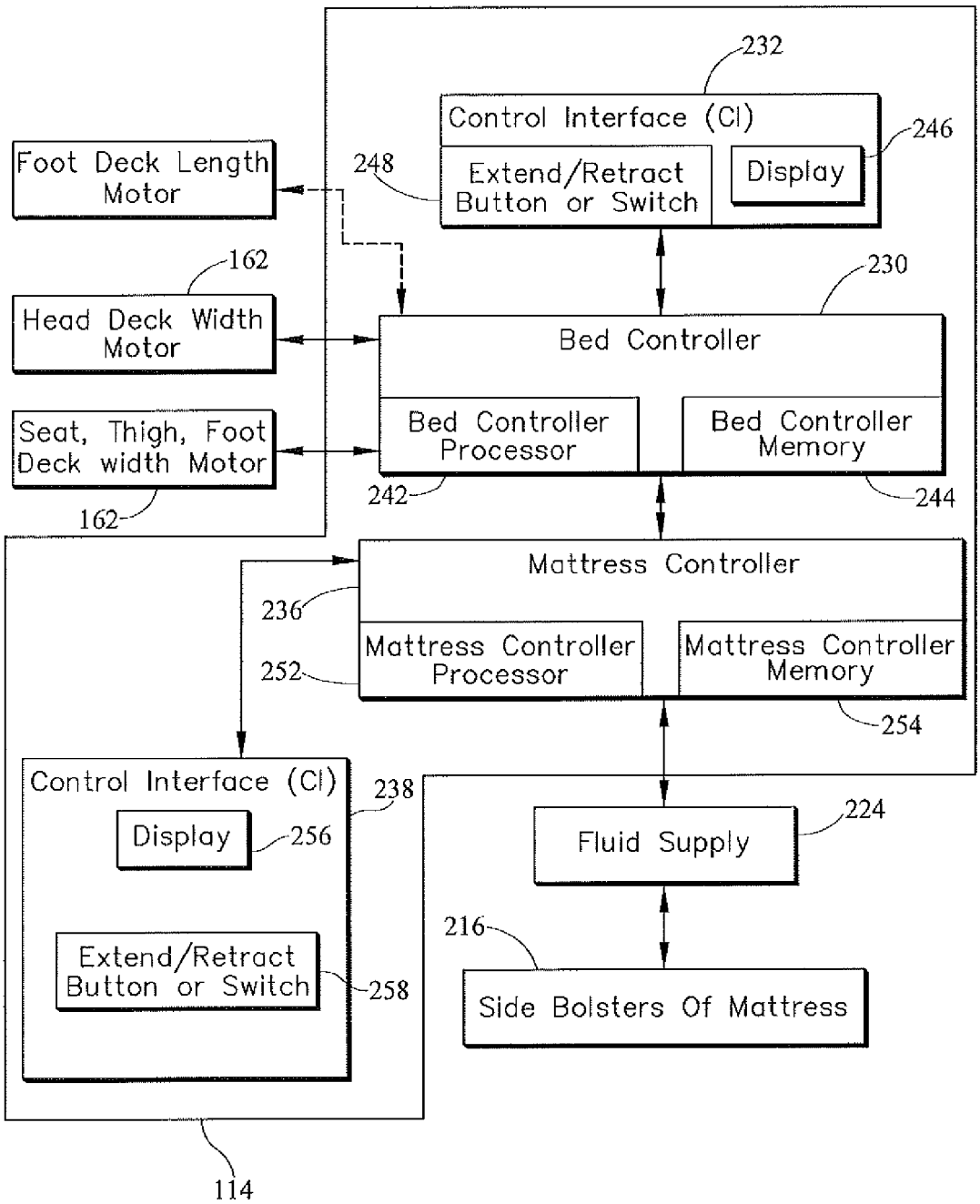
FIG. 11 is a block diagram of one embodiment of a system configured to change width of a person support apparatus, constructed according to one or more of the principles disclosed herein.
Figure 12:
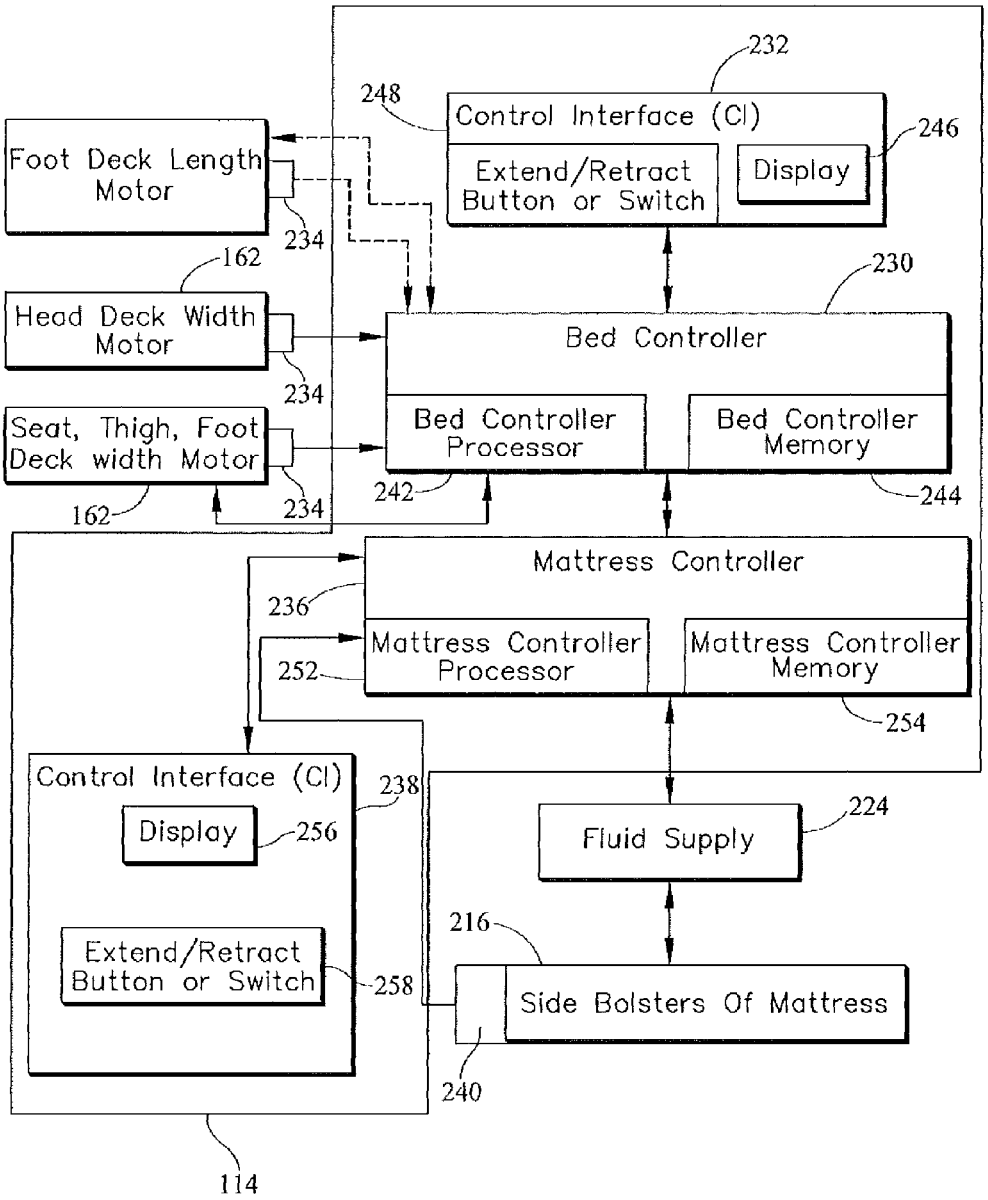
FIG. 12 is a block diagram of another embodiment of a system configured to change width of a person support apparatus, constructed according to one or more of the principles disclosed herein.
Figure 13:
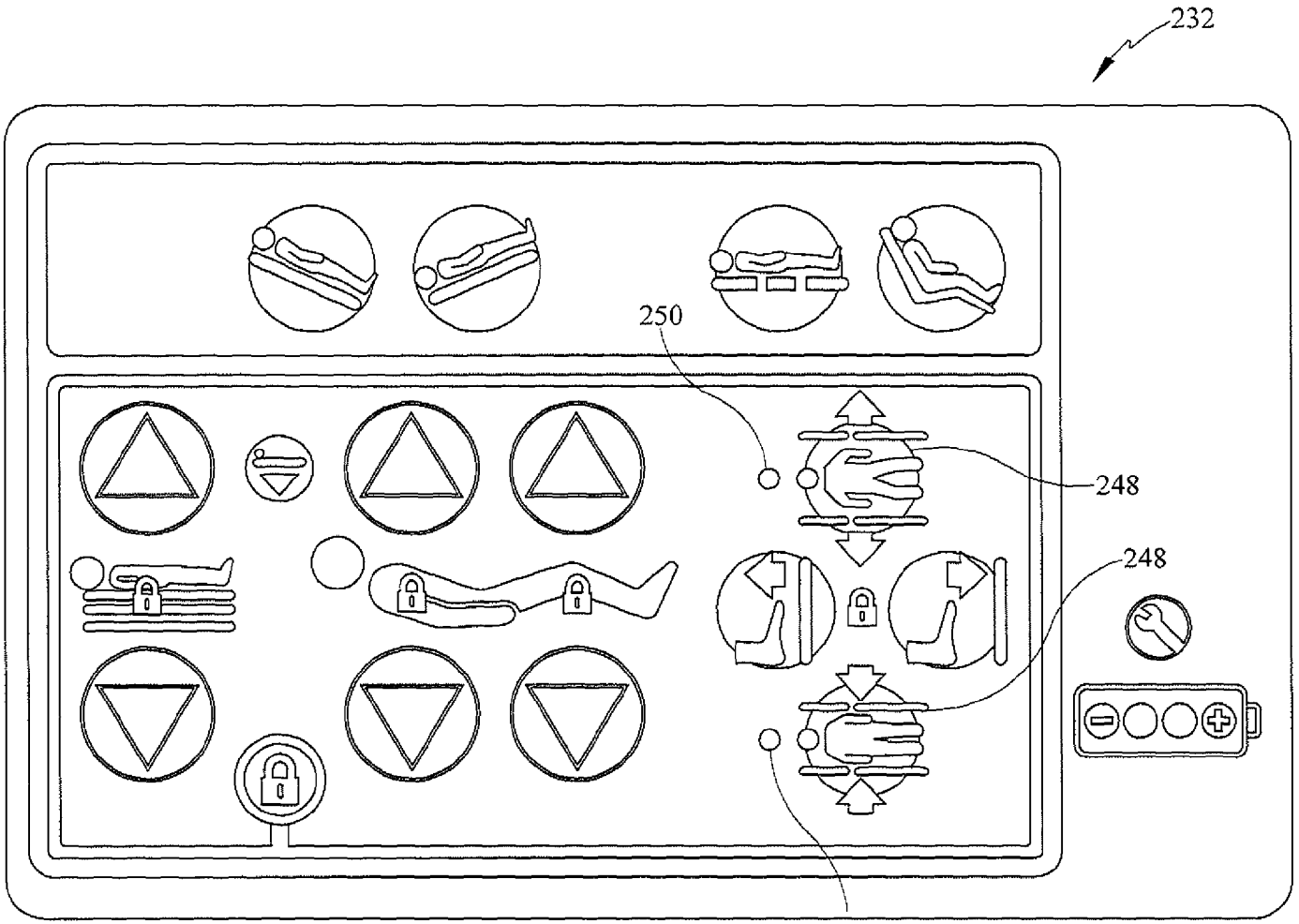
FIG. 13 is a view of a control interface having a retract button and an extend button that a user uses to reduce or expand respectively the width of the person support apparatus.

The control system 114 shown in FIGS. 11-13 is configured to control operation of the powered extension/retraction system 156 and fluid supply system 222 in response to an input from the user corresponding to a desired change in width of the person support structure 100 in order to extend/retract the deck extensions 134 and inflate/deflate the side bolsters 220, respectively. In some contemplated embodiments, other functions of the person support apparatus 110 and/or the mattress 114 may be controlled by the control system 114, such as, for example, articulation and height adjustment, therapies and alarms. The control system 114 includes a person support apparatus controller or bed controller 230, a person support apparatus control interface or bed control interface 232, person support apparatus sensors or bed sensors 234, a mattress controller 236, mattress control interface 238, and mattress sensors 240. The bed controller 230 is configured to control at least one function of the person support apparatus 110 in response to a user input received via the bed control interface 232 or in response to manual operation to alter the width of a deck section 132 (e.g., a person actuating the manual release assembly 158 and pushing or pulling on the deck extension 134 or the siderail 138 to extend/retract the deck extension 134 manually). The bed controller 230 includes a bed controller processor 242 and a bed controller memory 244. The bed control interface 232 is in communication with the bed controller processor 242 which is configured to receive a signal indicative of selection of the button 248. The bed controller memory 244 is configured to store procedures to be executed by the bed controller processor 242 and information regarding the status of the person support apparatus 110, including the position of at least one of the deck extensions 134, threshold values of position which would indicate full extension or retraction, and information received from the bed sensors 234 and bed control interface 232. In one contemplated embodiment, when the deck extension 134 is fully retracted or extended it hits a mechanical stop causing a surge in electric current to the motor 162 which is recorded by the bed controller 230 and used to determine whether the deck extensions 134 are completely extended or retracted.

The bed sensors 234 are configured to sense characteristics of the bed components, such as, the position of the deck extensions 134 (fully extended/retracted), the position of the siderail 138 (deployed/storage), and the orientation of the deck sections 132. The bed sensors 234 can include potentiometers, limit switches, hall-effect sensors, or other similar sensing devices and techniques. The bed sensors 234 can be coupled to the extensions 134 and/or the motors 162 or sense the position of the deck extensions 134 with respect to the deck sections 132. In one contemplated embodiment, potentiometers are mounted on the shafts of the motors 162 to sense the motion of the deck extensions 134 and allow the bed controller 230 to track the position of the extensions 134. In some contemplated embodiments, the sensors 234 also include force sensors, pressure sensors, and other sensors configured to sense characteristics and statuses of other systems and components of the person support apparatus 110.

The bed control interface 232 shown in FIGS. 1 and 11-13 is removably mounted on the siderail 138 in one contemplated embodiment. The bed control interface 232 includes a display 246 configured to display alerts and visual messages to a viewer, and at least one button 248 to control the extension and retraction of at least one deck extension 134. The display 246 in one embodiment is a Liquid Crystal Display (LCD) screen although any other technology could is used in other embodiments. The button 248 is a physical push button while in another embodiment the display 246 is a touch sensitive screen and button 248 is displayed on the touch sensitive screen. The bed control interface 232 shown in FIG. 13 may employ a button 248 for commanding both extension and retraction while in other embodiments the bed control interface 232 may comprise one button for commanding extension 248E and a separate button for commanding retraction 248R. The control interface 232 also has indicator lights 250E and 250R. When the extensions 134 are fully extended, light 250E glows steady green and light 250R is off. When the extensions 134 are fully retracted, light 250R glows steady green and light 250E is off. When the extensions 134 are in an intermediate state (neither fully extended nor fully retracted) one or both of the lights 250E and 250R flashes amber.

The mattress control interface 238, as shown in FIGS. 11 & 12, is coupled to the mattress control box 228 and is configured to display alerts and visual messages to a viewer. In some contemplated embodiments, the alerts and visual messages provide information about the status of the mattress 112, the fluid supply 224, and therapies being provided by the mattress 112. In one contemplated embodiment, the mattress control interface 238 is constructed like the bed control interface 232 above and includes a display 256 and at least one button 258 to control the extension and retraction of the side bolsters 216. The mattress control interface 238 can also include buttons for controlling other functions of the mattress 112, including, activating/deactivating therapies and increasing/decreasing pressure within the fluid bladders 220.

The mattress controller 236 is configured to control the fluid supply system 222 in response to a user input provided via the mattress control interface 238 (or via the bed control interface 232 when the mattress controller 236 and the bed controller 230 are in communication with one another). The mattress controller 236 includes a mattress controller processor 252 and mattress controller memory 254 as shown in FIGS. 11 & 12. The mattress controller memory 254 is configured to store procedures that may be executed by processor 252 and information regarding the status of the mattress 112, including the pressure within the side bolsters 216, threshold values of pressure which would indicate full inflation or deflation of the side bolsters 216, and information received the mattress sensors 240 or mattress control interface 238. The mattress controller 236 is enclosed in the mattress control box 228 and is electrically coupled to the fluid supply 224, the mattress control interface 238, and the mattress sensors 240. In some contemplated embodiments where the mattress 112 is integrated with the person support apparatus 110, the mattress controller 236 may be located with the bed controller 230, or combined with the bed controller 230 such that the bed controller 230 may be used to control functions of both the person support apparatus 110 and the mattress 112.

The mattress sensors 240 are configured to sense various characteristics of the mattress components, such as, the fluid pressure within the side bolsters 216 (fully extended/retracted), and to provide the sensed information to the mattress controller 236. In one contemplated embodiment, the mattress sensors 240 include pressure transducers that are configured to provide a signal indicative of the pressure inside the side bolsters 216 so that the mattress controller 236 can determine the inflation level of the side bolsters 216 (i.e., when they are fully deflated or fully inflated or partially inflated). In other contemplated embodiments, the mattress sensors 240 include temperature sensors, moisture sensors, force sensors, and other sensors, coupled to the mattress 112 to sense characteristics of the mattress 112, the fluid bladders 220, and/or the person positioned on the mattress 112. When the deck extensions 134 are retracted manually, the side rails 138 apply pressure on the side bolsters 216 as a user pushes the siderail 138 against the mattress 112, which causes a signal from the pressure transducer 240 to indicate a spike in pressure. If the mattress controller 236 determines that the spike is greater than a predetermined threshold, then the mattress controller 236 causes the fluid supply 224 to initiate deflation of the side bolsters 216.

The mattress controller 236 and the bed controller 230 are configured to communicate with one another to affect the extension/retraction of the deck extensions 134 and side bolsters 216. In some contemplated embodiments, the mattress controller 236 is configured to use the bed controller 230 as a communication hub to communicate information about the mattress 112 to caregivers via nurse call systems, to electronic medical record systems, and to other devices and systems. In the case of a mattress replacement system, the mattress controller 236 is in electrical communication with the bed controller 230 via a wired or wireless connection. In one contemplated embodiment, the mattress controller 236 communicates alarm signals to the bed controller 230 so that, instead of an alarm on the control box 228 being activated to alert people in or near the patient's room, a remote caregiver can be notified by the nurse call system of the alert. In other contemplated embodiments, the mattress controller 236 can communicate patient position information, therapy history (which can be used for compliance tracking), cushion pressures (which can indicate a fluid supply 32 issue or a leak), and/or other information about the mattress 16 or patient positioned thereon to a caregiver over a nurse call system or other caregiver alert system, an electronic medical record system, or the person support apparatus 110 or other medical devices in communication with the person support apparatus 110.

In one contemplated embodiment, when the mattress controller 236 is in electrical communication with the bed controller 230, the mattress control interface 238 on the control box 228 is disabled and the bed control interface 232 is used to control the functions of both the person support apparatus 210 and the mattress 112. In some contemplated embodiments, the mattress control interface 238 on the control box 228 does not display any information when it is deactivated. In another contemplated embodiment, the mattress control interface 238 can display information and/or errors, but control functions are locked out so that the user cannot control the operation of the mattress 112 from it. In some contemplated embodiments, the bed control interface 232 could be locked out instead of the mattress control interface 238. In some contemplated embodiments, the controls for inflating/deflating the side bolsters 216 from the bed control interface 232 and the mattress control interface 238 are disabled since the function is controlled as part of the width adjustment algorithm.

The mattress controller 236 and bed controller 230 periodically exchange a status signal to determine if they are connected. When communication between the bed controller 230 and the mattress controller 236 is interrupted, the mattress control interface 238 on the control box 228 is enabled (or re-activated) and allows the user to control the operation of the mattress 112. In some contemplated embodiments, visual and/or audible indicators are used to indicate when communication between the bed controller 230 and the mattress controller 236 is lost or interrupted; the loss of communication is sensed as an event, not a status. In another contemplated embodiment, when communication between the bed controller 230 and the mattress controller 236 is interrupted, the side bolsters 216 are deflated and retracted. A user may, subsequently, extend the side bolsters 216 to a desired position by pressing the corresponding button 258 on the mattress control interface 238. In another contemplated embodiment when communication between the bed controller 230 and the mattress controller 236 is lost, the deck extension/retraction function is locked out to prevent the user from using the powered extension/retraction system 156 to retract the deck section 134 and the mattress controller 236 maintains the mattress 112 in the state it was in prior to the mattress controller 236 losing communication with the bed controller 230.

In operation, the bed controller 230 and mattress controller 236 determine whether they are connected and, if so, the mattress controller 236 disables the mattress control interface 238 and routes all mattress control functions to the bed control interface 232. When the bed control interface 232 receives input indicative of a user's desire to increase or decrease the width of the person support apparatus 110 and mattress 112, the bed controller 230 activates the powered extension/retraction system 156 on the person support apparatus 110 to move the deck extensions 134 in the desired manner, and provides the mattress controller 236 with the information corresponding to the user's desired action. The mattress controller 236 uses the information from the bed controller 230 to control the operation of the fluid supply 224 to inflate/deflate the side bolsters 216. If the user does not fully extend or retract the deck extensions 134, the bed controller 230 sends a signal to the mattress controller 236 and the mattress controller 236 causes the side bolsters 216 to deflate and retract (or to maintain the fully retracted position). The user can manually override the deflation/retraction of the side bolsters 216 by controlling the mattress 112 directly through the mattress control interface 238. In some contemplated embodiments, if communication between the controllers is interrupted at any time, the side bolsters 216 are deflated and retracted.

Figure 15:
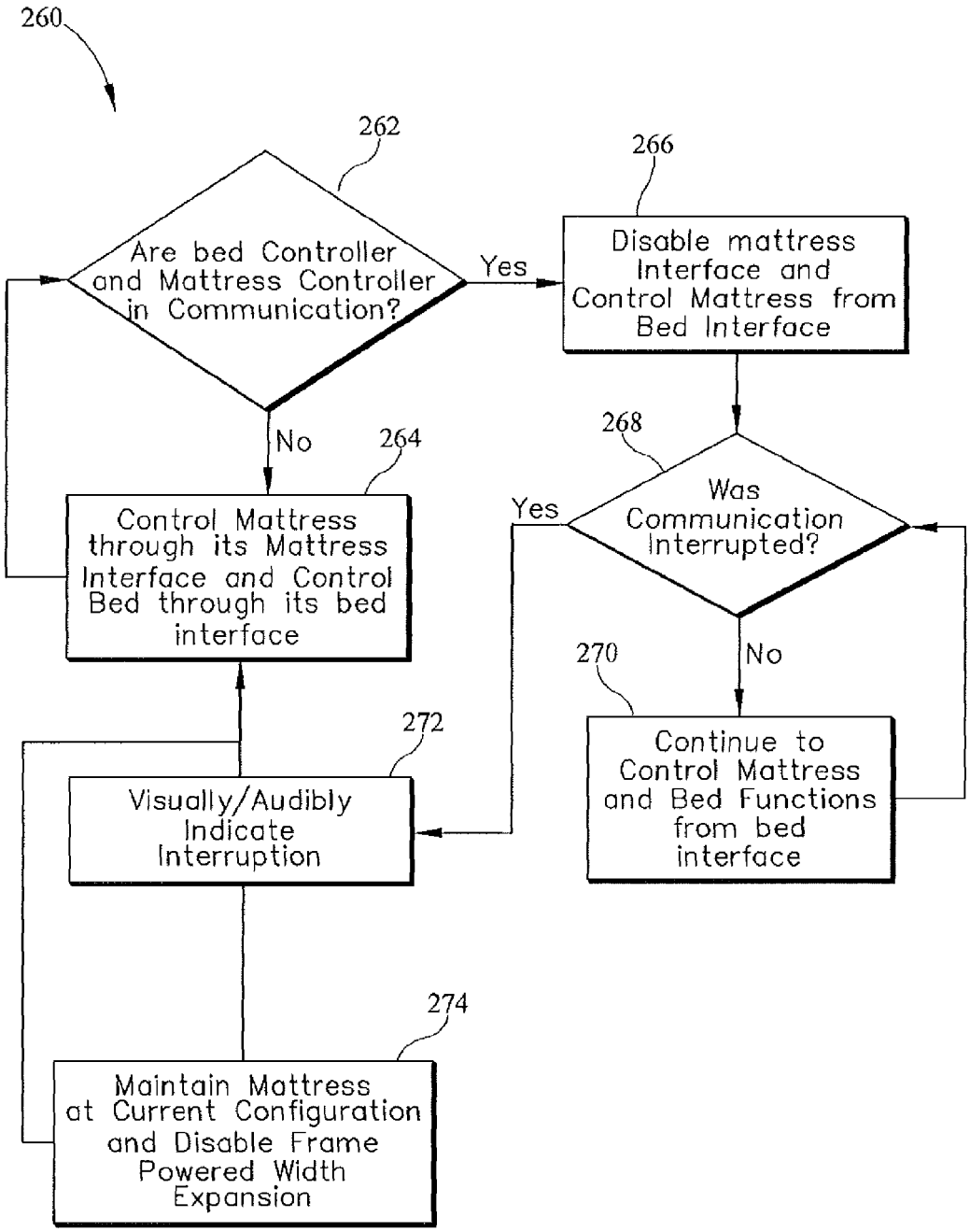
FIG. 15 is a flow chart of a method of monitoring a connection between a bed controller and a mattress controller.

A flow chart 260 of a method of monitoring the connection between the bed controller 230 and the mattress controller 236 according to one contemplated embodiment is shown in FIG. 15. In one contemplated embodiment, the procedure for monitoring the connection between the bed controller 230 and mattress controller 236 loops continuously. At operation 262, a determination is made the bed controller 230 and mattress controller 236 as to whether the controllers are in communication with one another. This can be accomplished when either controller fails to receive a periodic status signal from the other controller. If the controllers are in communication, then the mattress 112 is controlled through the mattress control interface 238 and the person support apparatus 110 is controlled through the bed interface 232 at step 264. The controllers return to monitoring the status of the connection between them at operation 262.

If the controllers are in communication, then the mattress control interface 238 is disabled (or at least the function control buttons are deactivated while information and alerts are still able to be displayed) and the mattress 112 is controlled through the bed control interface 232 at step 266. The controllers return to monitoring the status of the connection between them in operation 268 to determine if communications between the controllers is interrupted. If the communication between the controllers is not interrupted, the mattress control interface 238 remains disabled and the mattress 112 continues to be controlled through the bed control interface 232 at step 270, and the controllers return to monitoring the status of the communication connection at operation 268. In one contemplated embodiment, if the communication is interrupted, then a visual and/or audible alert is generated to indicate that communications have been interrupted between the controllers at operation 272, the mattress controller 238 maintains the status of the mattress 112 just prior to communication between the controllers being interrupted, and the bed controller 230 disables the powered width expansion function at operation 274 before proceeding to operation 264. In another contemplated embodiment, if communication is interrupted, a visual and/or audible alert is generated to indicate that communications have been interrupted between the controllers and the mattress controller 236 retracts the side bolsters 216 by deflating them before proceeding to operation 264.

Figure 16:
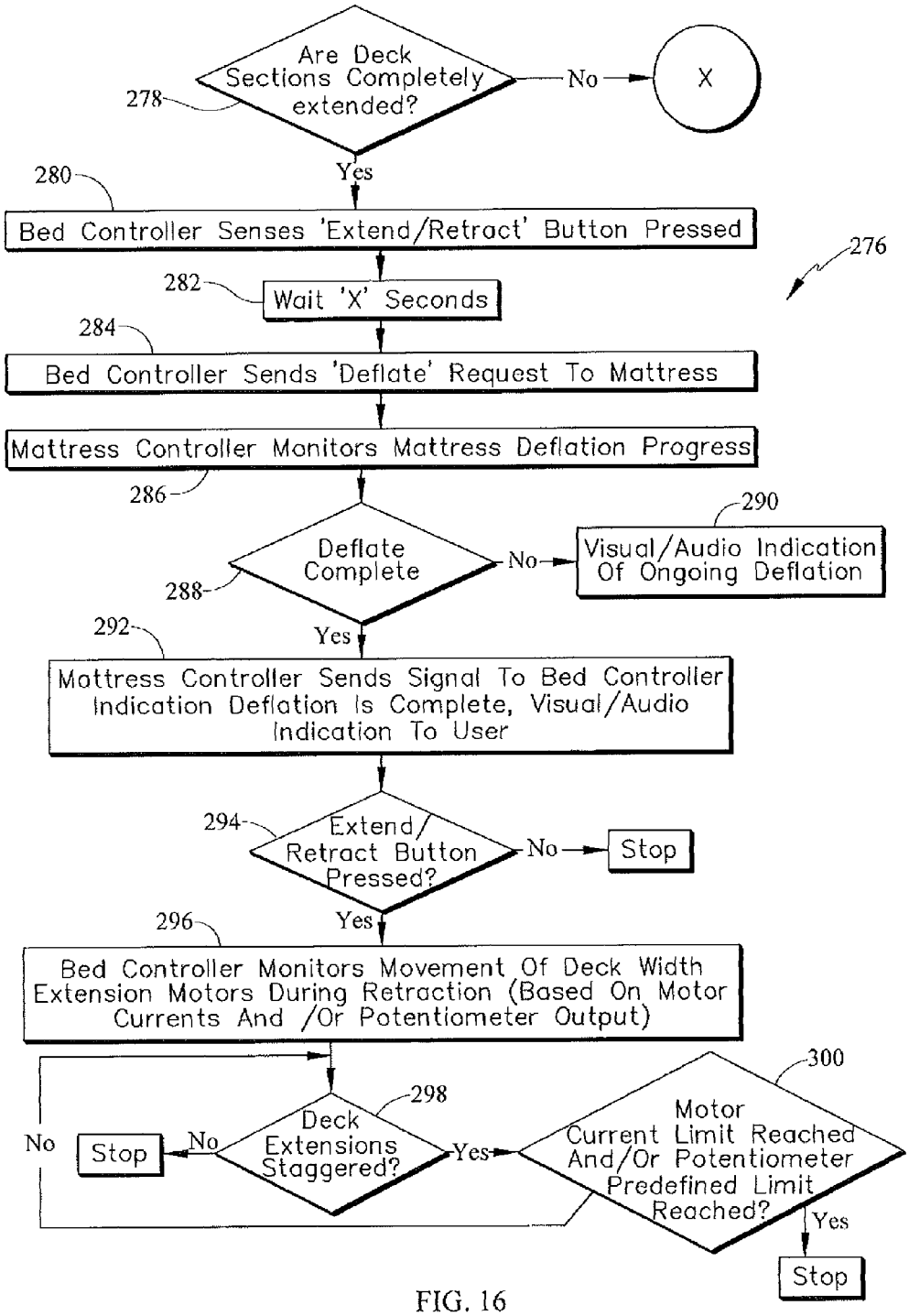
FIGS. 16-17 show a flowchart showing a first method of changing width of a person support apparatus, constructed according to one or more of the principles disclosed herein.
Figure 17:
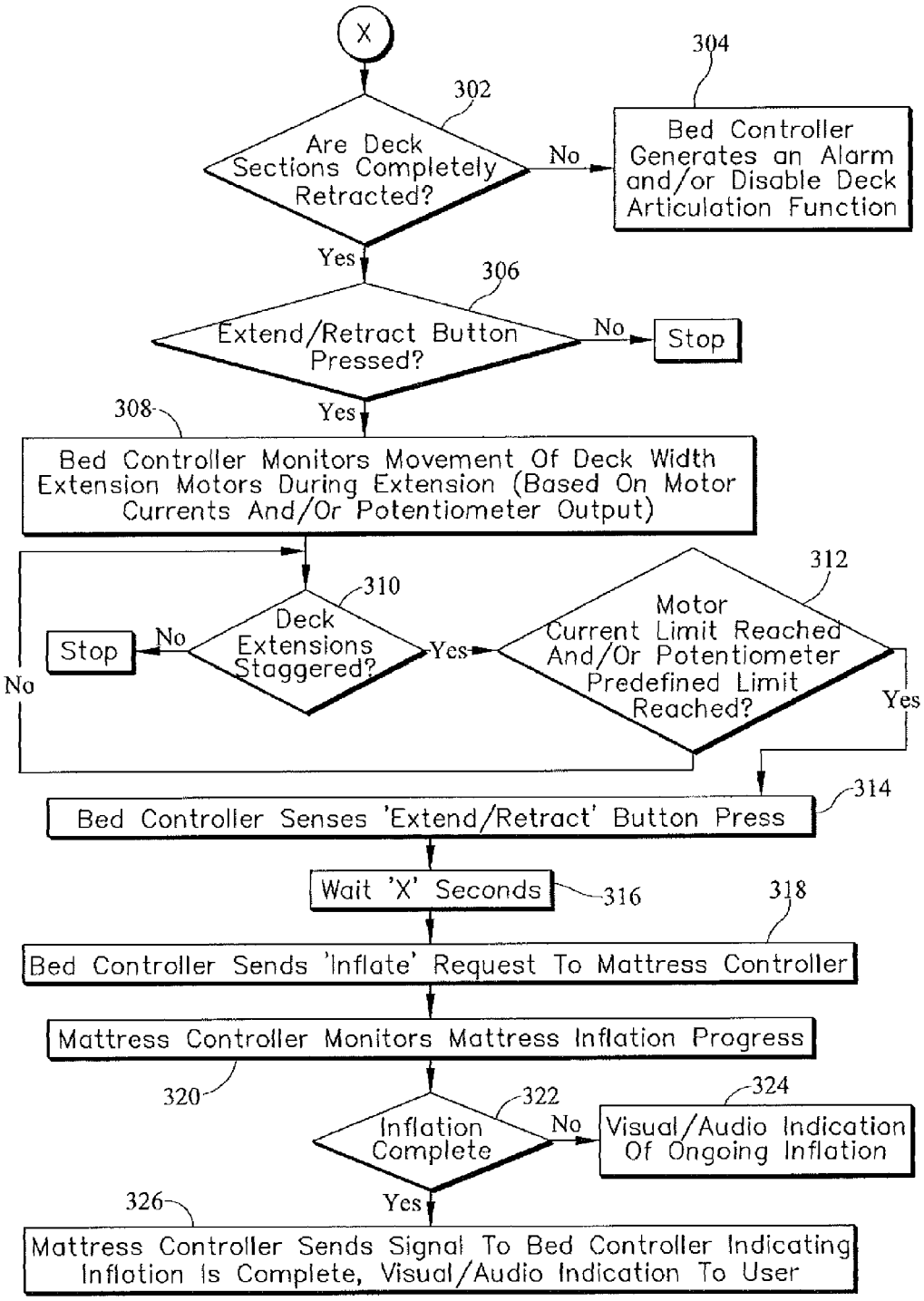

A flowchart 276 of a method of decreasing and increasing the width of a person support apparatus 110 according to one contemplated embodiment is shown in FIGS. 16 and 17, respectively. At operation 278, a determination is made by the bed controller 230 as to whether the deck extensions 134 are completely extended. If the deck extensions 134 are completely extended, the bed controller 130 senses selection of the retraction button 248R in operation 280 after which the system waits for a predetermined time, in one embodiment 2 seconds, in other embodiments, any amount of time in operation 282. The bed controller 230 sends a signal to the mattress controller 236 to deflate the mattress side bolsters 216 in operation 284. Mattress controller 236 monitors deflation of the mattress side bolsters 216 in operation 286. Mattress controller 236 determines if the mattress side bolsters 216 are completely deflated in operation 288. In one embodiment the mattress controller 236 makes this determination by comparing a pressure derived from the signal supplied by pressure transducer 240 with a predetermined threshold which in one embodiment may be defined by a user though control interface 232. In another embodiment the mattress controller 236 determines if the mattress side bolsters 216 are completely deflated by tracking the time spent deflating the mattress side bolsters 216. If the mattress controller 236 determines that the mattress side bolsters 216 are not completely deflated it sends a corresponding signal to the bed controller 230 at operation 290. The bed controller 230 sends the signal to the control interface 232 through which an audio indication and/or a visual indication on display 246 of ongoing mattress side bolster 216 deflation is communicated. If mattress controller 236 determines that deflation is complete at block 290 it communicates with the bed controller 230. The bed controller 230 sends a signal to the control interface 232 through which an audio indication and/or a visual indication on display 246 of completion of mattress side bolster 216 deflation is communicated in operation 292. The bed controller 230 now checks to determine whether retraction button 248R is selected at operation 294. If not, the bed controller 230 communicates a signal to the control interface 232 to display a message indicating that the mattress side bolsters 216 are deflated. If the bed controller 58 determines that the retraction button 248R is selected, it sends a signal to motors 162 coupled to the upper body deck section 140 and the lower body deck sections 142, 144, and 146 to begin retracting the deck extensions 134; the bed controller 230 monitors actuation of the deck extensions 134 in operation 296. In one contemplated embodiment, the deck extensions 134 are prevented from retracting if the deck sections 132 are in an articulated configuration. In another contemplated embodiment, articulation of the deck sections 132 is disabled while the extensions 134 are being extended/retracted. In another contemplated embodiment, extension/retraction of the deck extensions 134 and inflation/deflation of the side bolsters 216 are performed substantially simultaneously.

During actuation of the deck extensions 134, the bed controller 230 determines whether the deck extensions 134 are staggered in operation 298. In one contemplated embodiment, the bed controller 230 can determine whether the deck extensions 134 are staggered based on information sensed by the bed sensors 234 (for example, in one embodiment the bed sensors 234 include limit switches, while in another embodiment the bed sensor 234 include a potentiometer coupled to the motors 162 which the controller 230 can use to calculate the positions of the extensions 134). In another contemplated embodiment, the bed controller 230 can determine whether the deck extensions 134 are staggered by examining whether the motors 162 are synchronized where actuation of one extension 134 was delayed when compared the other extension 134. Staggering of the deck sections 134 can be achieved a number of ways. In one contemplated embodiment, the upper body deck extension 148 is retracted at faster speed than the lower body deck sections 150, 152, and 154, and extended at a slower speed than the lower body deck sections 150, 152, and 154 to stagger the extensions 134 such that the siderails 138 coupled thereto are not co-planar until the extensions 134 are fully extended. In another contemplated embodiment, the lower body deck extension 150, 152, and 154 and the upper body deck extension 148 are extended/retracted at substantially the same speed, but retraction of the lower body deck extensions 150, 152, and 154 are started a predetermined amount of time after retraction of the upper body deck extension 148, and extension of the lower body deck extensions 150, 152, and 154 are started at a predetermined time before extension of the upper body deck extension 148. Staggering the movement of the deck sections 134 helps to prevent potential interferences between the siderails 138 coupled to the deck sections 134 when the person support apparatus 110 is articulated.

The bed controller 230 monitors whether the end of travel indicative of complete retraction of deck extensions 134 has been reached based on signals from the potentiometer and/or current readings from the motors 162 in operation 300. In one contemplated embodiment, each extension 134 is extended/retracted to its limit irrespective of the staggering of the extensions 134. In another contemplated embodiment, the extensions 134 are extended/retracted until the first extension 134 reaches its limit, which maintains the extensions 134 in a staggered state. If the bed controller 230 determines complete extension/retraction of the deck extensions 134 has been reached, the bed controller 230 sends a signal to the motors 162 to stop actuation. If the bed controller 230 determines that the deck extensions 134 have not been completely extended/retracted upon the occurrence of a condition, the bed controller 230 can cause the person support apparatus 110 or mattress 112 to perform or lock out various functions. In one contemplated embodiment, the conditions include the user releasing the button 248 prior to the extensions 134 being fully extended/retracted, a bed power cord being unplugged, or the person support apparatus 110 being powered by a battery system (in one contemplated embodiment, the mattress controller 236 and fluid supply 224 are not powered by the person support apparatus 110 battery and the side bolsters 216 cannot be deflated or inflated when the person support apparatus 110 is running on the battery). When one of the aforementioned conditions occur it can cause the bed controller 230 to lock out articulation of the deck sections 132, generate an audible alarm, and/or flash an amber colored light 250 on the bed control interface 232. The bed controller 230 is also configured to generate fault codes for display on the bed control interface 232 or using diagnostic LEDs when, for example, the extension and retraction limits are not reached within a predetermined time, movement of the extension 134 is not sensed after the bed controller 230 sends a signal to the motor 162 to extend/retract the extension 134, the motor 162 is disconnected from the circuit, the bed sensors 234 or mattress sensors 240 signals are outside of an expected range, or the extend and retract limits are simultaneously met. When the fault codes are generated, the bed controller 230 can lock out the width expansion function and/or generate an audible alert or flash the light 250 to alert the user. In some contemplated embodiments, the sensors 234 and 240 are monitored real time and the position of each extension 134 is calculated at all times whether moving or stationary. In this embodiment, if the deck extensions 134 are not extended/retracted completely, the control system 114 determines whether the extensions 134 are substantially aligned. If they are not, then articulation of the deck sections 132 is prevented (specifically raising the upper body deck section 140 is prevented).

At operation 302, a determination is made by the bed controller 230 as to whether the deck extensions 134 are completely retracted. In one contemplated embodiment, if the deck extensions 134 are not completely extended or retracted, then the bed controller 230 generates an audible and/or visual alert and disables articulation of the deck sections 132. In this embodiment, raising the upper body deck section 140 can be disabled while lowering the upper body deck section 140 can still enabled. In another contemplated embodiment, if the deck extensions 134 are not completely extended or retracted, then the bed controller 230 sends a signal to the mattress controller 236 to cause the side bolsters 216 to retract. If the deck extensions 134 are completely retracted, the bed controller 230 checks to determine whether extension button 248E is selected at operation 306. If the bed controller 230 determines that the extension button 248E is selected, it sends a signal to upper body deck width motor 162 and lower body deck width motor 162 to begin extending the deck extensions 134; the bed controller 230 monitors actuation of the deck extensions 134 in operation 308. During actuation of the deck extensions 134, the bed controller 230 determines whether the deck extensions 134 are staggered in operation 310. If the bed controller 230 determines that the deck extensions 134 are not staggered, it sends a signal to the control interface 232 to display an error message. In some contemplated embodiments, the controller 230 can modify the speed at which the motors 162 are extending or retracting the extensions 134 to generate the desired stagger. If the bed controller 230 determines that the deck extensions 134 are staggered, the bed controller 230 monitors whether the end of travel indicative of complete extension has been reached based on signals from the potentiometer 234 and/or current readings from the motors 162 in operation 144. If the bed controller 230 determines that complete extension of each deck extension 134 has been reached, the bed controller 230 sends a signal to the motors 162 to stop actuation. If the bed controller 230 determines that the deck extensions 134 have not been completely extended, the bed controller 230 continues to monitor whether the motors 162 are staggered in step 310.

In operation 312 if it is determined by the bed controller 230 that the deck extensions 134 are completely extended, the bed controller senses selection of the extension button 248E in operation 314 after which the system waits for a predetermined time, in one embodiment 2 seconds, in other embodiments, any amount of time in operation 316. The bed controller 230 sends a signal to the mattress controller 236 to inflate the mattress side bolsters 216 in operation 318. Mattress controller 236 monitors inflation of the mattress side bolsters 216 in operation 320. Mattress controller 236 determines if the mattress side bolsters 216 are completely inflated in operation 322. In one embodiment the mattress controller 236 makes this determination by comparing a pressure derived from the signal supplied by pressure transducer 240 with a predetermined threshold which in one embodiment may be defined by a user though control interface 232. In another embodiment the mattress controller 236 determines if the mattress side bolsters 216 are completely inflated by tracking the time spent inflating the mattress side bolsters 216. In operation 322 if the mattress controller 236 determines the mattress side bolsters 216 are not completely inflated, it sends a corresponding signal to the bed controller 230. The bed controller 230 sends a signal to the control interface 232 through which an audio indication and/or a visual indication on display 246 of ongoing mattress side bolster 216 inflation is communicated in operation 324. If mattress controller 236 determines that inflation is complete it communicates with the bed controller 230. The bed controller 230 sends a signal to the control interface 232 through which an audio indication and/or a visual indication on display 246 of completion of mattress side bolster 216 inflation is communicated in operation 326.

In this embodiment the mattress side bolsters 216 are configured to toggle between a fully inflated state and a fully deflated state. In one embodiment the pressure indicative of full inflation is variable based on weight of the patient supported by the mattress 112 to a predetermined pressure relief set point. In another embodiment the pressure indicative of full inflation may be input by a user via the control interface 232. In another contemplated embodiment, pressure indicative of full inflation is a function of the position of the extension 134.

Figure 18:
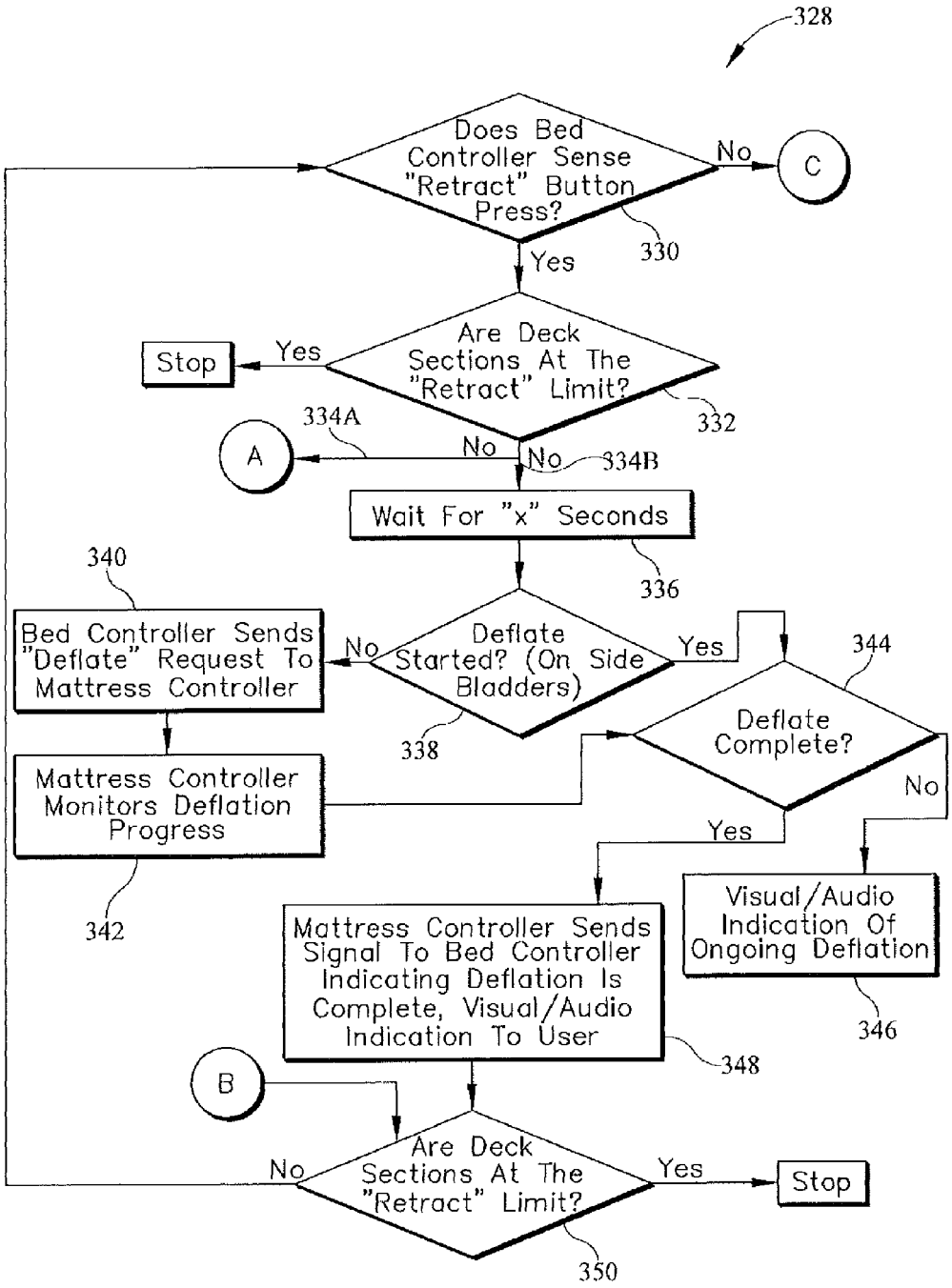
FIGS. 18, 18B, 19, and 19B are flowcharts showing a second method of changing the width of a person support apparatus.
Figure 19:
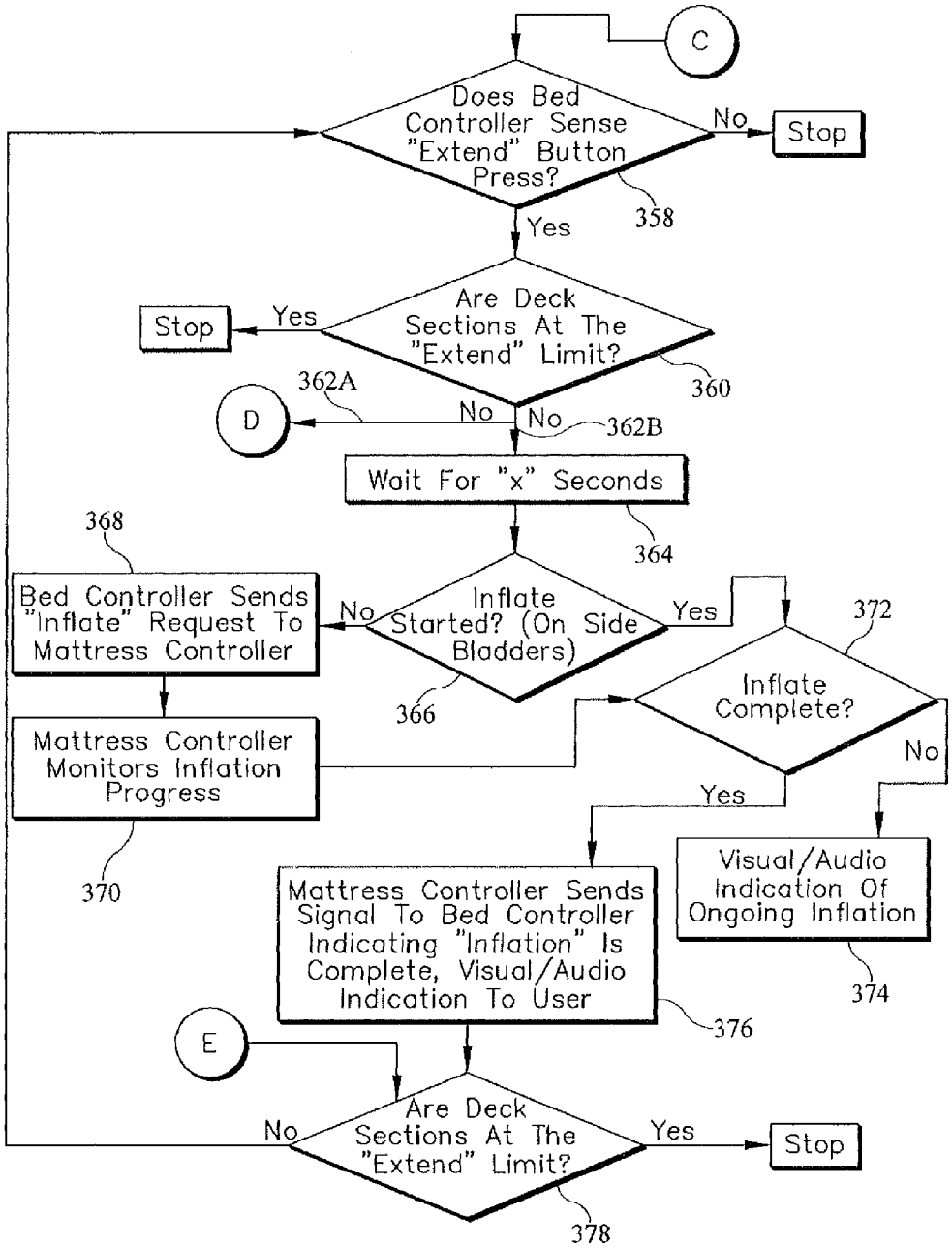

FIGS. 18 and 19 are block diagrams 328 showing a second method of altering the width of the bed 110 according to another contemplated embodiment. In FIG. 18, block 330 tests whether or not the bed controller 230 senses that retract button 248R is being pressed. If not the method proceeds to block 358 of FIG. 19 and tests whether or not the bed controller 230 senses that extend button 248E is being pressed. However if the test at block 202 reveals that the retract button 248R is being pressed the method proceeds to block 332. Pressing either button 248R or 248E generates a command to alter the width of the bed 110. The commands are of opposite polarity, i.e. one is to retract, the other is to extend.

Figure 18B:
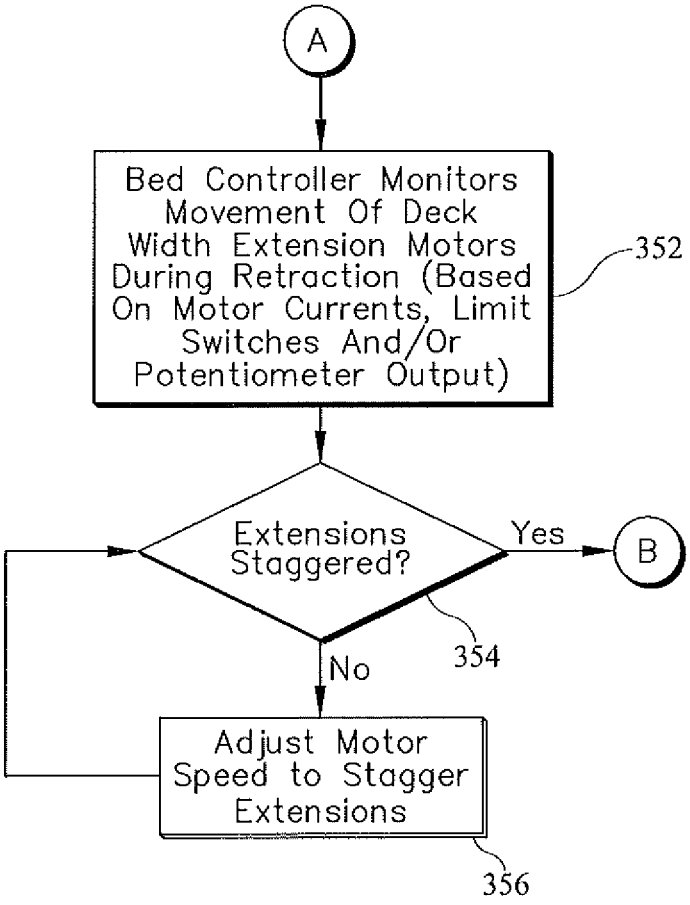

Block 332 tests whether or not the deck extensions 134 are at their limit of retraction. If so, the method stops except for continuing the tests of blocks 330 (FIG. 18) and 358 (FIG. 19). If the deck extensions 134 are not at their limit of retraction the method proceeds along paths 334A and 334B to blocks 352 (FIG. 18B) and 336 (FIG. 18) respectively. First considering path 334A, at block 352 the bed controller 230 monitors whether the deck extensions 134 (which are being moved as a result of a user continuing to press the retract button 248R) are staggered. If not the method proceeds to block 356 and changes the motors 162 speed to stagger the deck sections 134. If so the method branches to block 350 (FIG. 18). Now considering path 334B, at block 336 the method pauses or delays for a brief time interval (a second or two) while continuing to monitor whether or not the retract button 248R is still being pressed. If the user has continued to apply pressure to the retract button 248R throughout the pause interval, the method proceeds to block 338. However if user pressure on the retract button 248R is discontinued during the pause interval the method does not proceed to block 338. The pause interval enables the method to distinguish between a genuine user command and a brief inadvertent touch of the retract button 248R.

Block 338 tests whether or not deflation of the side bolsters 216 has begun. If not the bed controller 230 issues a "deflate" command to the mattress controller 236 at block 340. The mattress controller 236 responds by beginning deflation of the side bolsters 216. At block 342 the mattress controller 236 monitors deflation progress and proceeds to block 344. At block 344 the method tests whether or not deflation is complete either as a result of the actions at blocks 340 and 342 or as a result of having arrived directly at block 344 from block 338. If the test at block 344 reveals that deflation is not complete the method continues the deflation process and sends a visual and/or aural indication of the ongoing deflation. One example of a visual indication is the flashing yellow illumination of one of lights 250E and 250R as described above. If the test at block 344 reveals that deflation is complete the method proceeds to block 348 where the mattress controller 236 signals the bed controller 230 that deflation is complete and sends a visual and/or aural indication of the fact that deflation is complete. One example of a visual indication is the steady green illumination of light 250R as described above.

Irrespective of whether the method has followed path 334A through blocks 352 and 354 or has followed path 334B through the appropriate blocks beyond block 336, the method arrives at block 350 where it tests whether or not the deck extensions 134 are at their limit of retraction. If not, the method returns to block 330. If so, the method stops, except for continuing to monitor for whether or not the extend and retract buttons 248E and 248R are being pressed.

The portion of the method outlined in FIG. 19 is similar to the portion of the method disclosed in FIG. 18 but shows how the method responds to user pressure applied to the extend button 248E. In FIG. 19, block 358 tests whether or not the bed controller 230 senses that extend button 248E is being pressed. If not the method stops, although the test of block 358 (and of block 330 in FIG. 18) continues to be made. However if the test at block 358 reveals that the extend 248E button is being pressed the method proceeds to block 360.

Figure 19B:
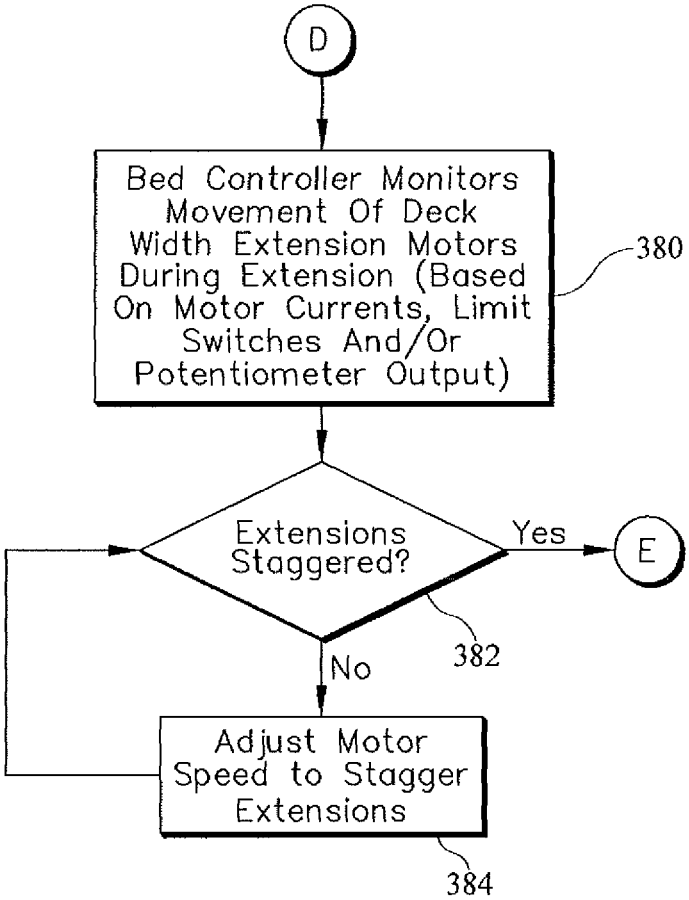

Block 360 tests whether or not the deck extensions 134 are at their limit of extension. If so, the method stops except for continuing the tests of blocks 330 and 358. If the deck extensions 134 are not at their limit of retraction the method proceeds along paths 362A and 362B to blocks 380 (FIG. 19B) and 364 (FIG. 19) respectively. First considering path 362A, at block 380 the bed controller 230 monitors whether the deck extensions 134 (which are being moved as a result of a user continuing to press the extend button 248E) are staggered. If not the method proceeds to block 384 and changes the speed of the motors 162 to stagger the deck sections 134. If so the method branches to block 378 (FIG. 19). Now considering path 362B, at block 364 the method pauses or delays for a brief time interval (a second or two) while continuing to monitor whether or not the extend button 248E is still being pressed. If the user has continued to apply pressure to the extend button 248E throughout the pause interval, the method proceeds to block 366. However if user pressure on the extend button 248E is discontinued during the pause interval the method does not proceed to block 366. The pause interval enables the method to distinguish between a genuine user command and a brief inadvertent touch of the retract button 248E.

Block 366 tests whether or not inflation of the side bolsters 216 has begun. If not the bed controller 230 issues a "inflate" command to the mattress controller 236 at block 368. The mattress controller 236 responds by beginning inflation of the side bolsters 216. At block 370 the mattress controller 236 monitors inflation progress and proceeds to block 372. At block 372 the method tests whether or not inflation is complete either as a result of the actions at blocks 368 and 370 or as a result of having arrived directly at block 372 from block 366. If the test at block 372 reveals that inflation is not complete the method continues the inflation process and sends a visual and/or aural indication of the ongoing inflation. One example of a visual indication is the flashing yellow illumination of one of lights 250E and 250R as described above. If the test at block 372 reveals that inflation is complete the method proceeds to block 376 where the mattress controller 236 signals the bed controller 230 that inflation is complete and sends a visual and/or aural indication of the fact that inflation is complete. One example of a visual indication is the steady green illumination of light 250E as described above.

Irrespective of whether the method has followed path 362A through blocks 380 and 382 or has followed path 362B through the appropriate blocks beyond block 364, the method arrives at block 378 where it tests whether or not the deck extensions 134 are at their limit of extension. If not, the method returns to block 358. If so, the method stops, except for continuing to monitor for whether or not the extend and retract buttons 248E and 248R are being pressed.

As previously noted the deck extensions 134 can be extended and retracted manually. In the case of manual operation the step of determining whether or not the extend or retract buttons 248E or 248R are pressed (blocks 330 and 358) will not yield a "yes" answer. However the bed controller 230 is still able to monitor current readings or potentiometer 240 signals to track the position of the deck extension 134, including whether or not the deck extension 134 is at its extend limit or retract limit. As a result the method for manual operation is the same except that instead of being initiated by the bed controller 230 sensing whether or not the retract or extend button 248E or 248R is being pressed (blocks 330, 358) it is initiated by changes in the current readings or potentiometer signals. Similar to the case of push-button operation, manual operation generates a width alteration command. If a user pushes on the deck extensions 134 (or a component attached to the deck extensions 134) to cause the deck extensions 134 to retract, the command is a retract command. If a user pulls on the deck extensions 134 (or a component attached to the deck extensions 134) to cause the deck extensions 134 to extend, the command is an extend command. The retract and extend commands are of opposite polarity.

The foregoing description and associated FIGS. 18 and 19 address retraction and extension explicitly. More generally the method monitors for a command to alter the width of the deck and determines the polarity of the command (blocks 330, 358). The method ensures that the deck extension 134 is not at a limit inconsistent with the polarity of the command (blocks 330, 358), operates powered extension/retraction system 156 to move the deck extension 134 in a direction consistent with the polarity of the command (implicit in blocks 352, 380) and issues a fluid supply control signal (not explicitly shown, but a consequence of blocks 340, 368) to operate the fluid supply 224 in a manner consistent with the polarity of the command. The fluid supply control signal is issued in response to a mattress control signal (output of blocks 340, 368). The mattress control signal is generated in response to the command.

The method monitors response of the mattress 112 to operation of the fluid supply 224 at blocks 342, 370. The method of curtails operation of powered extension/retraction system 156 in response to the deck extension 134 reaching a limit consistent with the polarity of the command. The issuing step is conditioned on continued presence of the command during a pause interval (blocks 336, 364). The method also includes the step of providing an indication distinguishing between completion and incompletion of width adjustment (blocks 346, 374).

Figure 8:
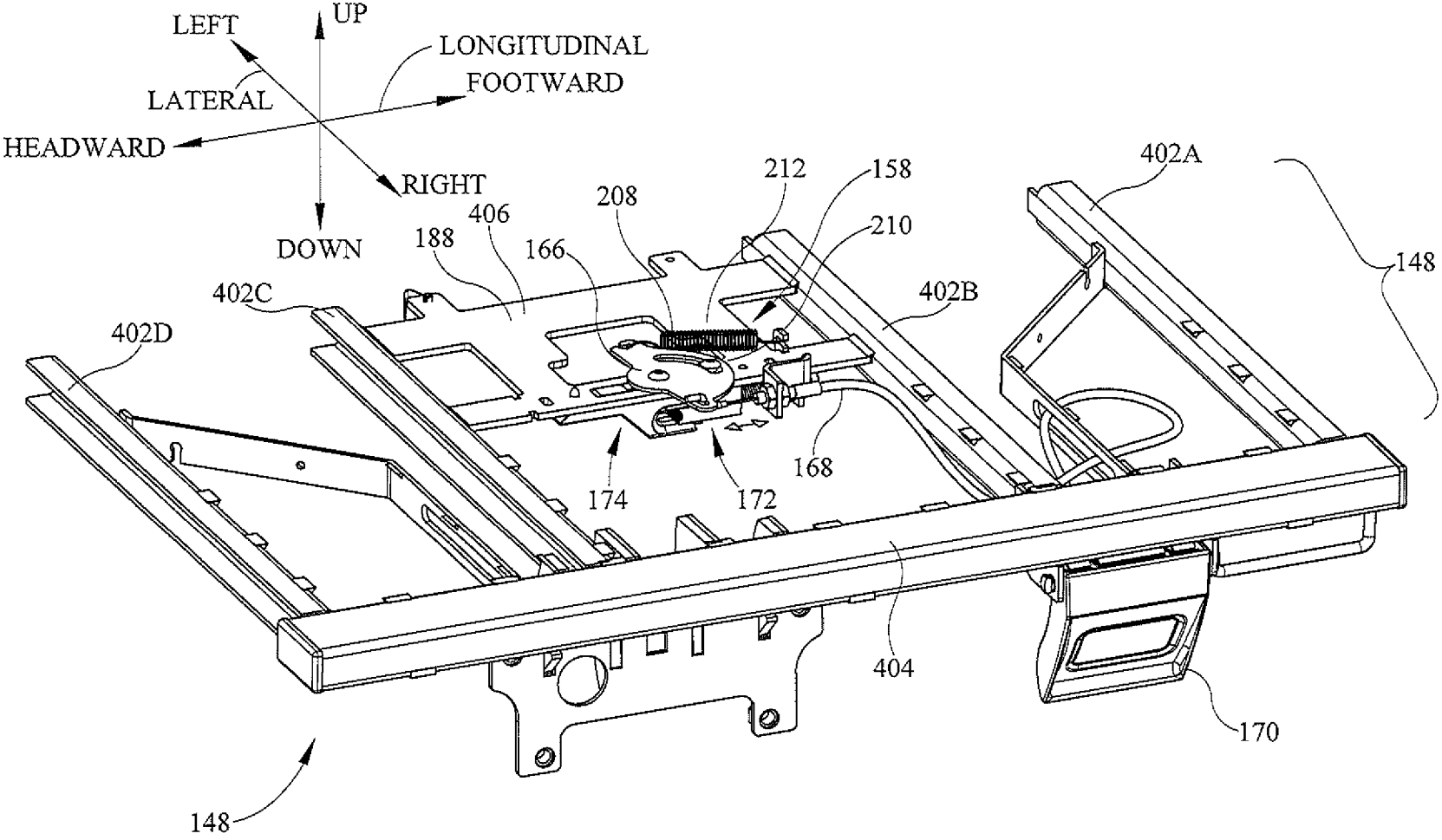
FIG. 8 is a perspective top view of the manual release assembly.

Referring principally to FIGS. 5 and 8, an embodiment of upper body section deck extension 148, also referred to as a wing, includes laterally extending spars 402 and a laterally outboard, longitudinally extending rail 404. A bridge 406 spans between the two longitudinally innermost spars 402B, 402C. As already described clasp 164 and clasp separator 166 are mounted to the wing.

Referring to FIGS. 4-8 and 20-23 an embodiment of the upper frame 118 of a person support apparatus includes an upper body deck section 140 having a framework which includes laterally extending supports configured as C-channels 410. One of each of the wing spars 402A, 402B, 402C, 402D nests within a corresponding C-channel 410A, 410B, 410C, 410D so that the spars are laterally translatable with respect to the channels. The illustrated embodiment includes four wing spars and four C-channels, however other quantities of spars and channels in a one to one correspondence may be used depending on design requirements. Friction reducing elements such as rollers (not visible in the illustrations) are used to reduce friction between the spars and the C-channels. The upper body deck section framework also includes longitudinally extending beams 412. Beam 412C coincides with deck section centerline 416 and may be referred to as a center beam.

Figure 23:
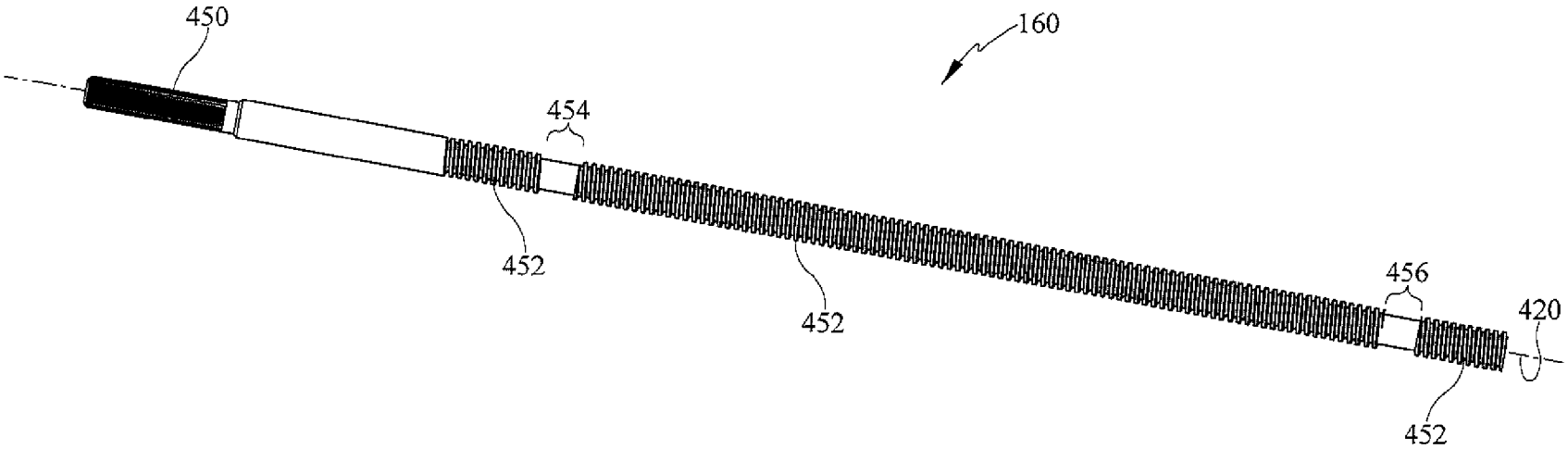
FIG. 23 is a view of a leadscrew.

A bearing block 418 projects upwardly from each of the beams except for the center beam. Two bearing blocks 418B, 418D are partially visible in FIG. 20, one extending from a flange portion of beam 412B, the other extending from a flange portion of beam 412D. Two additional bearing blocks, 418A, 418E, are partially visible in FIG. 21, one extending from beam 412A, the other extending from beam 412E. A hole, not visible, extends through each bearing block such that the hole axis is parallel to the leadscrew axis which is shown in FIG. 23. A bushing, also not visible, resides in each bearing block hole. One or more motor mount brackets 422 supports left and right motor assemblies 424L, 424R from the center beam (left and right are taken from the vantage point of a person lying face up on the person support system with his head nearer to the head end of the person support system and his feet nearer the foot end of the person support system.

Figure 22:
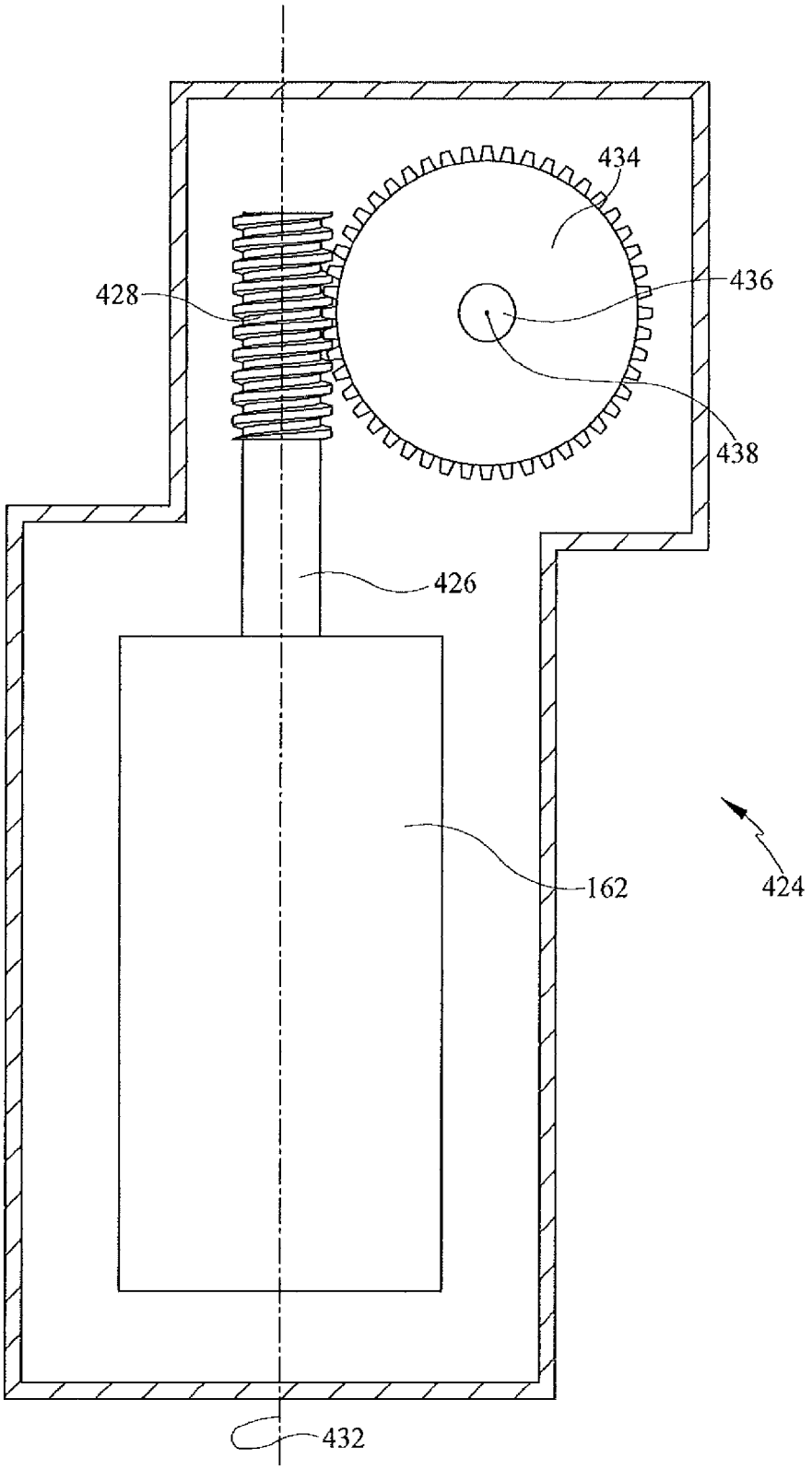
FIG. 22 is a schematic view of a motor assembly.

Due to symmetry it will suffice to describe only one representative motor assembly (the right motor assembly) and the elements associated with it. Accordingly, the suffixes L and R will be appended to the reference numerals only as needed in the remainder of this description. Referring to FIG. 22 representative motor assembly 424 includes a motor 162 with an output shaft 426 and a worm gear 428 at the end of the shaft. The shaft and worm are rotatable about a motor axis 432 which extends substantially parallel to centerline 416. The motor assembly also includes a pinion 434 engaged with the worm and having a pinion shaft 436 rotatable about a pinion shaft rotational axis 438. Taken together the worm and pinion define a gear train.

Referring to FIG. 23 an inboard end of leadscrew 160 includes a spline 450. The leadscrew also includes a drive thread 452 interrupted by inboard and outboard unthreaded segments 454, 456. The terms "inboard" and "outboard" refer to locations laterally closer to or laterally more distant from centerline 416. The spline is engaged with the pinion shaft 436. The leadscrew extends away from the motor assembly and through a clasp 164 on the same lateral side of the bed so that drive threads 452 engage the threads on threaded end 192 of clasp member 172 (FIG. 5). The leadscrew also extends through the bushings in the two bearing blocks 418 on the same lateral side of the bed.

Figure 20:
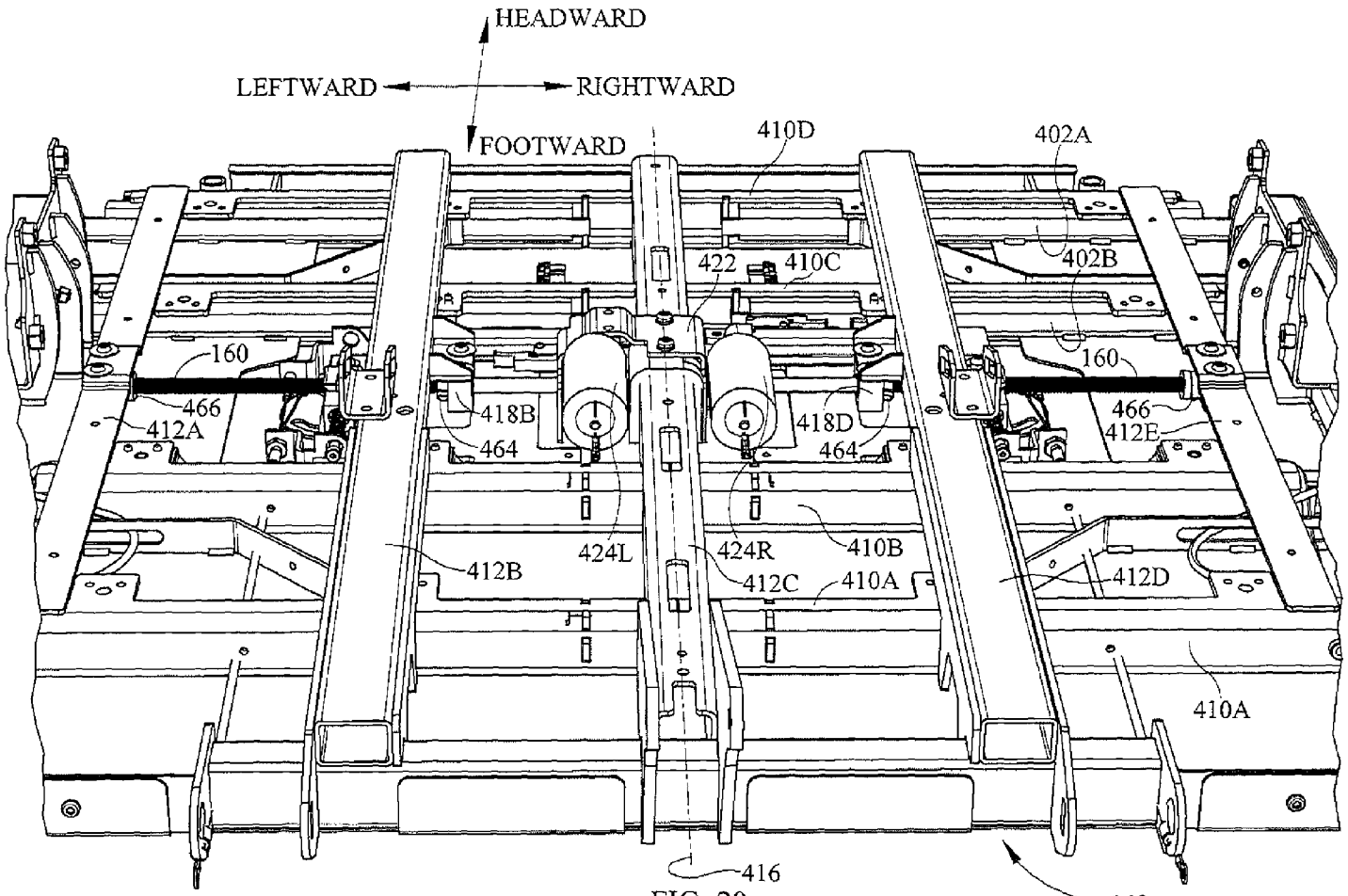
FIG. 20 is a view showing an upper body deck section framework as seen from underneath, the section comprised of laterally extending supports configured as C-channels and longitudinally extending beams, and also showing portions of a deck extension comprised of spars which nest within the C-channels.
Figure 21:
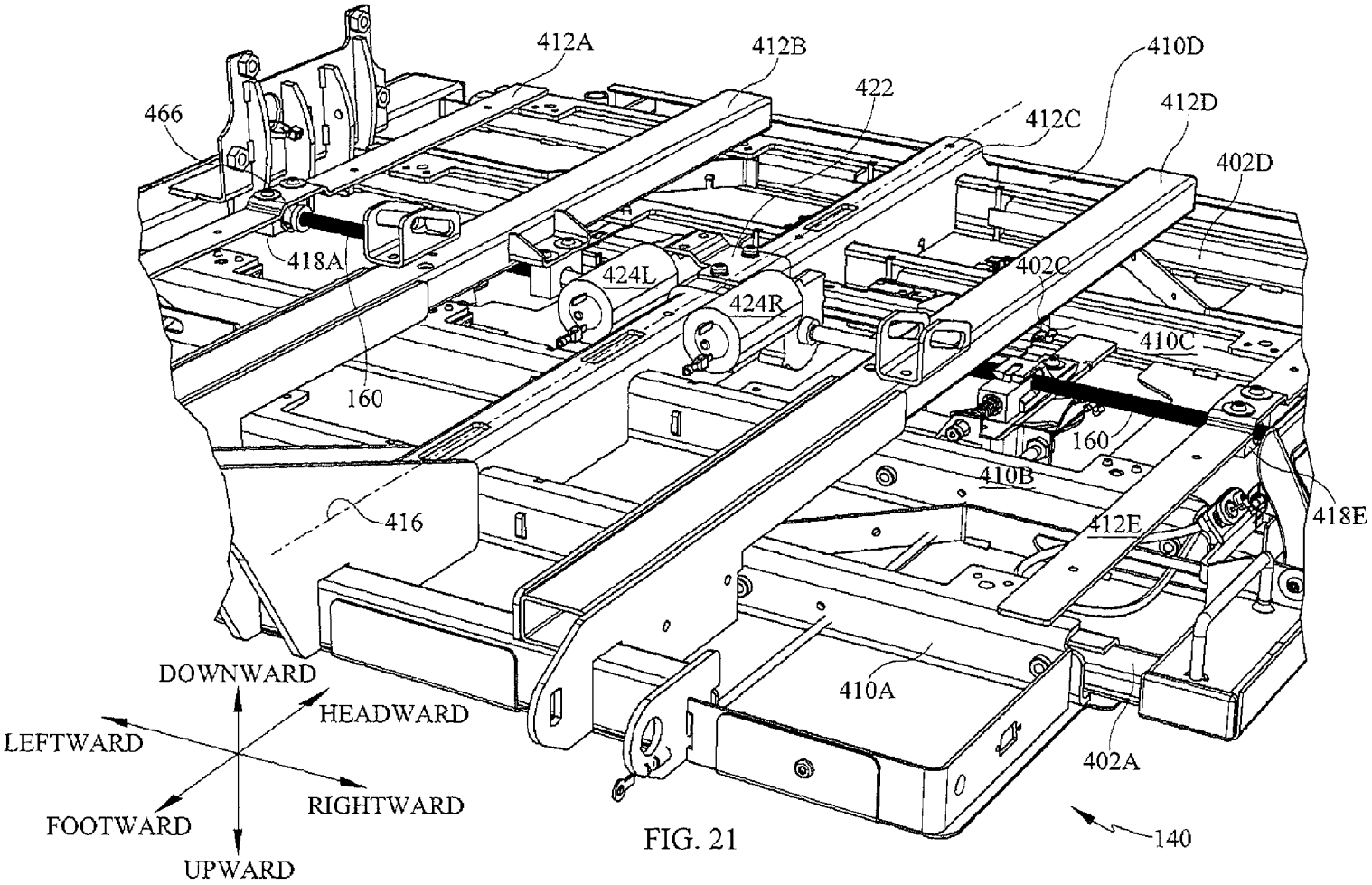
FIG. 21 is view similar to that of FIG. 20 but slightly rotated.

As seen best in FIG. 20 an inboard ring 464 circumscribes the inboard unthreaded segment 454 of the leadscrew. An outboard ring 466 circumscribes the outboard unthreaded segment 456 of the leadscrew. The unthreaded segments, and therefore the rings, are located on the leadscrew so that outboard ring 466 resides immediately inboard of an outboard bearing block such as bearing block 418A (visible in FIG. 21) or 418E, and so that inboard ring 464 resides immediately outboard of an inboard bearing block such as bearing block 418B or 418D as seen in FIG. 20. The diameter of each ring is large enough that the ring will not pass through the bushing in the adjacent bearing block. As a result the rings prevent the leadscrew from moving parallel to its own axis 420.

When clasp 164 is engaged as seen in FIG. 6, the clasp acts as a leadscrew receiver. Operation of a motor in a first or forward rotational direction moves the corresponding clasp, and therefore the wing to which the clasp is secured, in a laterally outboard direction. Operation of the motor in a second or reverse rotational direction, opposite that of the first rotational direction, moves the corresponding clasp and wing in a laterally inboard direction. The terms "forward" and "reverse" are used merely to distinguish between opposite rotational senses.

Figure 24:
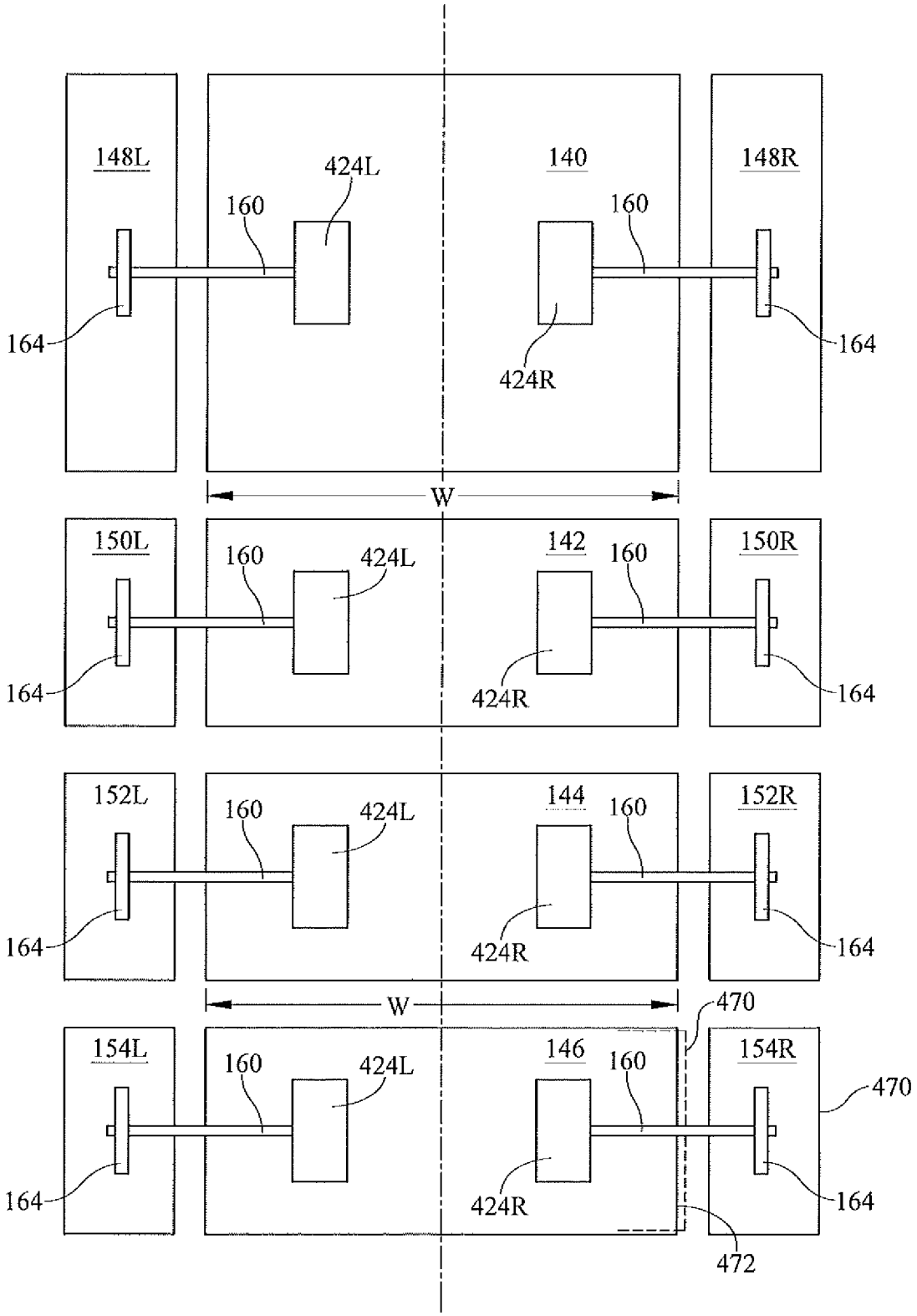
FIG. 24 is a schematic plan view of a bed architecture having four deck sections each of which includes a left side motor assembly, a left wing or deck extension driven by the left motor assembly by way of a left leadscrew, a right side motor assembly, and a right wing or deck extension driven by the right motor assembly by way of a right leadscrew.

FIG. 24 is a schematic representation of an architecture having four deck sections, an upper body section 140, a seat section 142 a thigh section 144 and a foot section 146, all four of which are rendered width adjustable by corresponding extension wings 148, 150, 152, 154. Each deck section has a width W and an outboard edge 472. The architecture includes eight motor assemblies 424, two mounted on each of the four deck sections. Two motor assemblies are associated with and dedicated to one and only one of the four sections such that one of the two motor assemblies drives the left leadscrew and the left wing of the section and the other of the two motor assemblies drives the right leadscrew and the right wing of that same section. In general, in a bed having at least two deck sections, and in which at least two of those sections are width adjustable sections, each section is serviced by its own pair of motor assemblies. Each motor can move its corresponding wing between a deployed position in which the lateral extremity 470 of the wing is outboard of the outboard edge 472 of the corresponding deck section and a stored position in which the lateral extremity 470 is inboard of its deployed position as shown in phantom in FIG. 24 for one of the foot section extensions 154. When the wing is stored its outboard extremity 470 may be outboard of, inboard of, or substantially laterally aligned with outboard edge 472 of the corresponding deck section.

Figure 25:
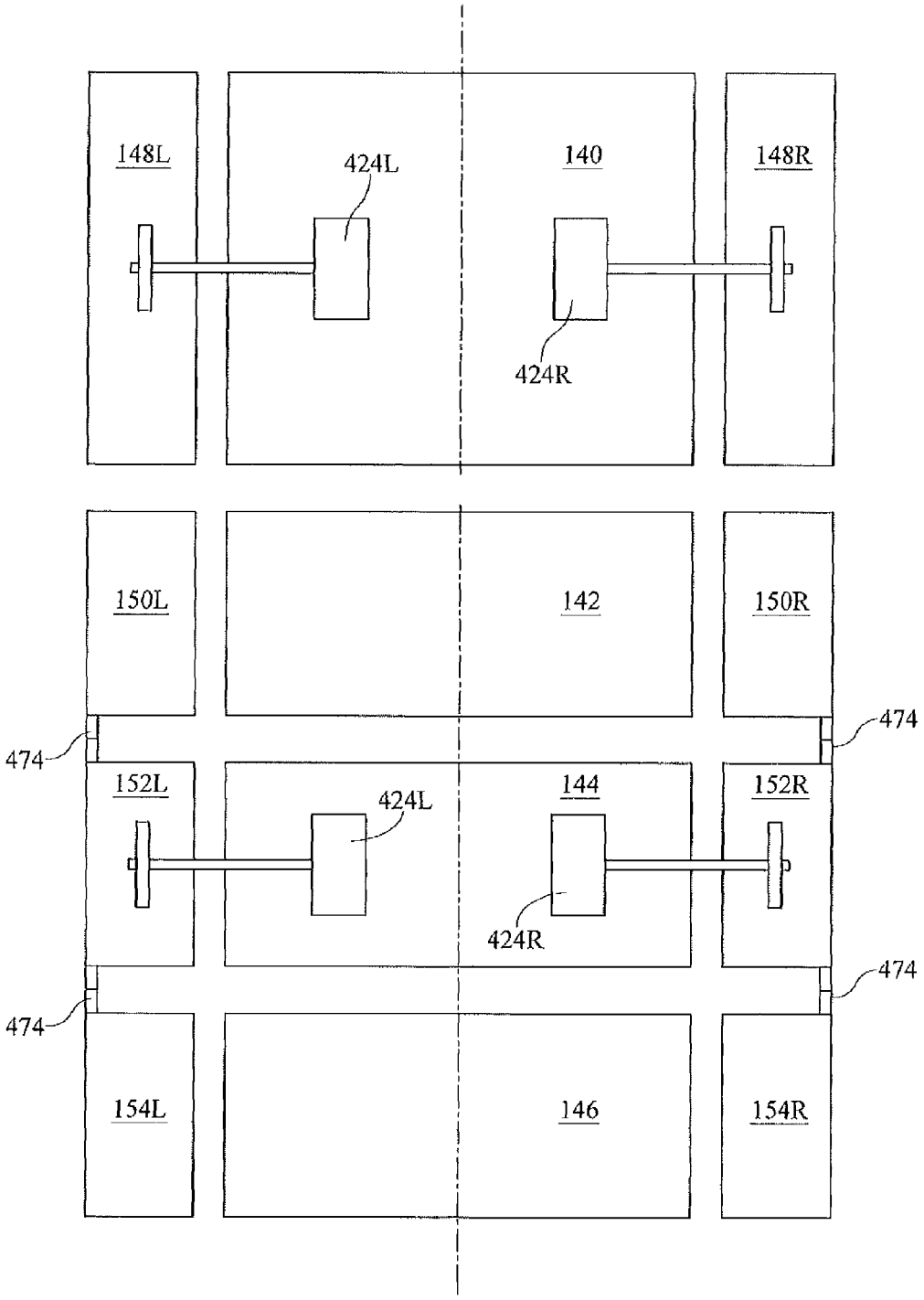
FIG. 25 is a schematic plan view of a bed architecture having four deck sections and shared left and right motor assemblies mounted on one of the sections such that left and right deck width extensions of that section are directly driven by the respective left and right motor assemblies and such that left and right width extensions of adjacent deck sections are indirectly driven by the motor assemblies as a result of links connecting the directly driven extensions to the indirectly driven extensions.

FIG. 25 shows an alternative in which the wings of at least two of the deck sections are movable by a common or shared motor assembly. For example, a right motor assembly 424R is connected to thigh deck segment 144. Wing 152R of section 144 is a directly driven wing because it is driven directly by the motor assembly. Wing 150R of the seat section is an indirectly driven wing connected to the directly driven wing 152R by a link 474 which conveys the lateral motion of the directly driven wing 152R to the indirectly driven wing 150R. Wing 154R of the foot section is similarly an indirectly driven wing. Motor assembly 424R of section 144 is considered to be a shared motor assembly because its driving energy is shared by at least two wings, the directly driven wing 152R and the indirectly driven wings 150R and/or 154R. Wings 150R, 154R are also considered to be proximate indirectly driven wings because they are immediately adjacent to a directly driven wing. Section 144 may be referred to as a directly driven section. Section 140 may also be referred to as a directly driven section, and its wings 148 as directly driven wings even though wings 148 are not connected to longitudinally adjacent wings such as wings 150. Sections 142, 146 may be referred to as indirectly driven sections or as indirectly driven proximate sections.

Figure 26:
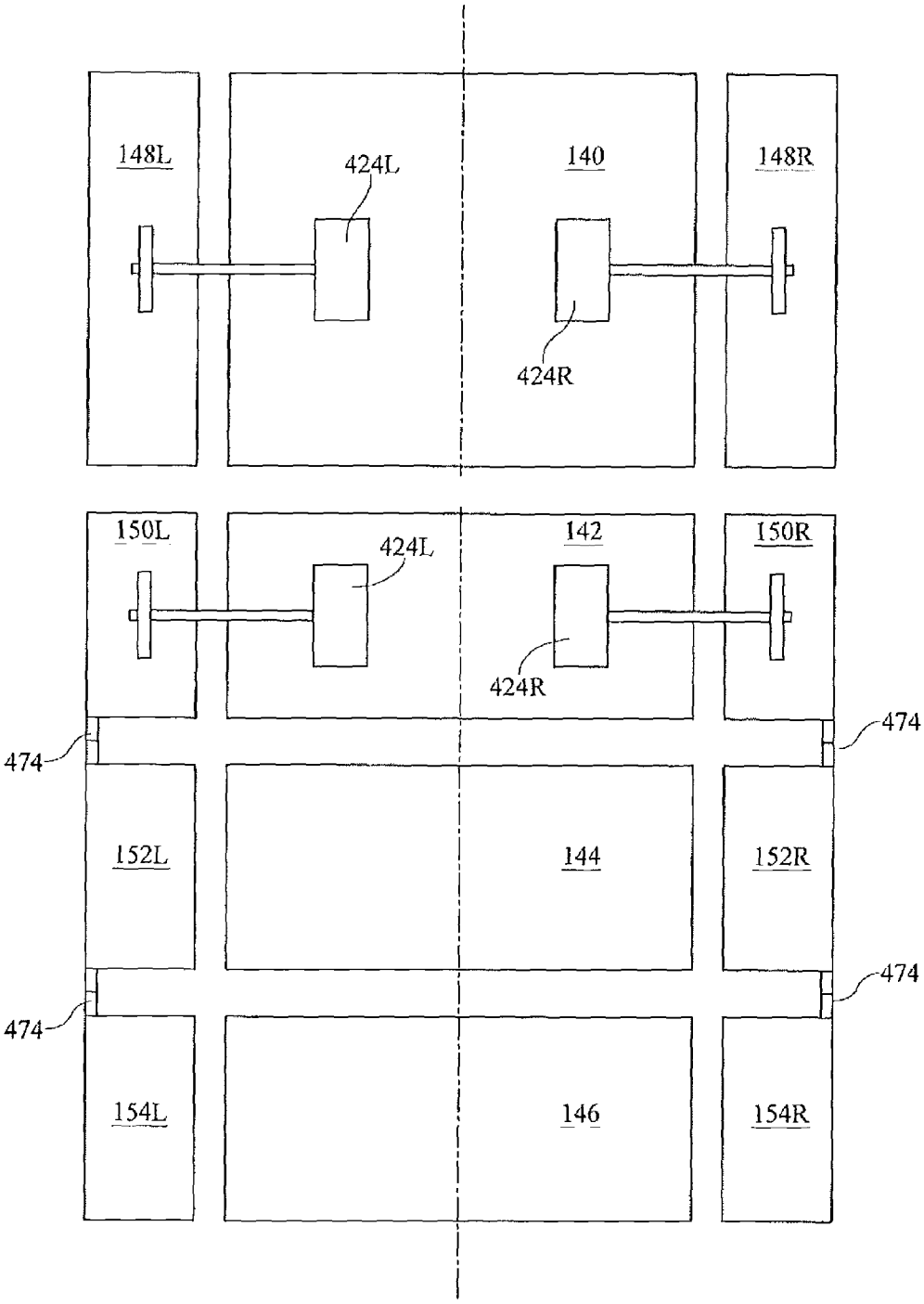
FIG. 26 is a schematic plan view of a bed architecture having four deck sections and shared left and right motor assemblies mounted on one of the sections such that left and right deck width extensions of that section are directly driven by the respective left and right motor assemblies and such that left and right proximate width extensions are indirectly driven by the motor assemblies as a result of links connecting the directly driven extensions to the proximate indirectly driven extensions and such that left and right remote width extensions are indirectly driven by the motor assemblies as a result of links connecting the remote extensions to the proximate extensions.

FIG. 26 shows another alternative in which the wings of at least two of the width adjustable segments are movable by a common or shared motor assembly. A motor assembly 424R is mounted on seat deck segment 142. Wing 150R of section 142 is a directly driven wing because it is driven directly by motor assembly 424R. Wing 152R of the thigh section is an indirectly driven wing connected to directly driven wing 150R by a link 474 which conveys the lateral motion of the directly driven wing 150R to the indirectly driven wing 152R. Wing 154R of the foot section is also an indirectly driven wing, but because it is adjacent to another indirectly driven wing (wing 152R) rather than adjacent to a directly driven wing (wing 150R) wing 154R is considered to be a remote indirectly driven wing. Section 142 may be referred to as a directly driven section. Section 140 may also be referred to as a directly driven section, and its wings 148 as directly driven wings even though wings 148 are not connected to longitudinally adjacent wings such as wings 150. Section 144 may be referred to as an indirectly driven section or as an indirectly driven proximate section to distinguish it from section 146. Wings 152 may similarly be referred to as indirectly driven wings or, to distinguish them from wings 154, as indirectly driven proximate wings. Section 146 may be referred to as an indirectly driven section or, in order to distinguish it from section 144, as an indirectly driven remote section.

The use of the terms "a" and "an" and "the" and similar referents in the context of describing the subject matter (particularly in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. Furthermore, the foregoing description is for the purpose of illustration only, and not for the purpose of limitation, as the scope of protection sought is defined by the claims as set forth hereinafter together with any equivalents thereof entitled to. The use of any and all examples, or exemplary language (e.g., "such as") provided herein, is intended merely to better illustrate the subject matter and does not pose a limitation on the scope of the subject matter unless otherwise claimed. The use of the term "based on" and other like phrases indicating a condition for bringing about a result, both in the claims and in the written description, is not intended to foreclose any other conditions that bring about that result. No language in the specification should be construed as indicating any non-claimed element as essential to the practice of the invention as claimed.

The disclosures of any references and publications cited above are expressly incorporated by reference in their entireties to the same extent as if each were incorporated by reference individually.

What is claimed is:

1. A system for changing a width of a person support apparatus, comprising:

a bed controller configured to receive a command signal indicative of a command for width alteration;

a first motor configured to be controlled by the bed controller, the first motor configured to drive an extension of a first deck section of the support apparatus thereby altering a width of the first deck section;

a second motor configured to be controlled by the bed controller, the second motor configured to drive an extension of a second deck section of the support apparatus thereby altering a width of the second deck section, wherein:

the bed controller controls the first motor and the second motor in a manner that causes the first deck section to reach a first deck section width alteration limit at a first time and the second deck section to reach a second deck section width alteration limit at a second time, wherein the first time and the second time are not equal.

2. The system of claim 1, wherein the first motor and the second motor are controlled to operate at different speeds.

3. The system of claim 1 wherein the first motor is controlled to alter the width of the first deck section beginning at a first starting time and the second motor is controlled to alter the width of the second deck section beginning at a second starting time which is a predetermined amount of time after the first starting time.

4. The system claim 1 wherein the bed controller activates the first motor, waits a predetermined amount of time, and then activates the second motor.

5. The system of claim 1 wherein the first deck section and the second deck section are prevented from being articulated until both the first deck section and the second deck section reach respective width alteration limits.

6. The system of claim 5 wherein the width alteration limit of the first deck section is defined by a fully extended position or a fully retracted position of the extension of the first deck section and the width alteration limit of the second deck section is defined by a fully extended position or a fully retracted position of the extension of the second deck section.

7. The system of claim 5 wherein the width alteration limit of the first deck section includes a fully extended position or a fully retracted position of the extension of the first deck section and the width alteration limit of the second deck section includes a fully extended position or a fully retracted position of the extension of the second deck section.

8. The system of claim 5 wherein the bed controller generates an alarm if a distal end of the extension of the first deck section and a distal end of the extension of the second deck section are not staggered such that the distal ends of the extensions reach their respective width alteration limits at different times.

9. The system of claim 1 wherein the command signal is generated in response to manual operation to alter the width of the first deck section or the second deck section.

* * * * *